US011925843B1

(12) United States Patent
Bicanic et al.

(10) Patent No.: US 11,925,843 B1
(45) Date of Patent: Mar. 12, 2024

(54) PLAYING IMPLEMENT FOR A PADDLE FOR FACILITATING PLAYING WITH THE PADDLE

(71) Applicants: Nikola Vladimir Bicanic, Venice, CA (US); Troy Michael Hamner, Carlsbad, CA (US)

(72) Inventors: Nikola Vladimir Bicanic, Venice, CA (US); Troy Michael Hamner, Carlsbad, CA (US)

(73) Assignee: RELOAD TECHNOLOGIES, INC., Venice, CA (US)

( * ) Notice: Subject to any disclaimer, the term of this patent is extended or adjusted under 35 U.S.C. 154(b) by 0 days.

(21) Appl. No.: 18/217,617

(22) Filed: Jul. 3, 2023

Related U.S. Application Data

(63) Continuation-in-part of application No. 18/110,386, filed on Feb. 16, 2023.

(60) Provisional application No. 63/429,982, filed on Dec. 3, 2022.

(51) Int. Cl.
*A63B 59/40* (2015.01)

(52) U.S. Cl.
CPC ..... *A63B 59/40* (2015.10)

(58) Field of Classification Search
CPC ..... A63B 59/40; A63B 59/42; A63B 59/80; A63B 60/004; A63B 2102/08; A63B 2209/00–18
See application file for complete search history.

(56) References Cited

U.S. PATENT DOCUMENTS

| | | | | |
|---|---|---|---|---|
| 2014/0066235 | A1* | 3/2014 | Hill | A63B 59/48 473/528 |
| 2016/0193793 | A1* | 7/2016 | Filippini | B29D 99/0014 264/138 |
| 2016/0250533 | A1* | 9/2016 | O'Rourke | A63B 59/42 473/527 |
| 2017/0021247 | A1* | 1/2017 | Marvin | A63B 59/40 |
| 2017/0136325 | A1* | 5/2017 | Fox | A63B 59/42 |
| 2019/0269986 | A1* | 9/2019 | Mazursky | A63B 60/50 |
| 2021/0252356 | A1* | 8/2021 | Thurman | A63B 59/42 |
| 2022/0032141 | A1* | 2/2022 | Brents | A63B 60/54 |
| 2022/0040937 | A1* | 2/2022 | Simmons | B29C 70/68 |
| 2023/0249042 | A1* | 8/2023 | Barnes | A63B 59/42 473/519 |

FOREIGN PATENT DOCUMENTS

| | | | |
|---|---|---|---|
| GB | 1127473 A | * | 5/1966 |
| TW | M640119 U | | 4/2023 |

* cited by examiner

*Primary Examiner* — Joshua T Kennedy
(74) *Attorney, Agent, or Firm* — Burris Law, PLLC

(57) ABSTRACT

A playing implement for a paddle for facilitating playing with the paddle. Further, the playing implement may include a surface plate. Further, the surface plate may be comprised of at least one layer of material. Further, the surface plate may be configured to be removably attached to a core portion of the paddle using at least one adhesive. Further, the at least one adhesive may be applicable on an inner side of the surface plate. Further, the surface plate has a shape corresponding to a core shape of the core portion. Further, the surface plate may include a playing surface on an outer side of the surface plate. Further, the outer side opposes the inner side.

10 Claims, 26 Drawing Sheets

PLAYING IMPLEMENT FOR A PADDLE FOR FACILITATING PLAYING WITH THE PADDLE

CROSS-REFERENCE TO RELATED APPLICATION

This application is a continuation in part application of U.S. patent application Ser. No. 18/110,386, entitled "A PLAYING IMPLEMENT FOR A PADDLE FOR FACILITATING PLAYING WITH THE PADDLE," filed on 16 Feb. 2023, which is incorporated by reference herein in its entirety.

FIELD OF THE INVENTION

Generally, the present disclosure relates to the field of amusement devices: games. More specifically, the present disclosure relates to a playing implement for a paddle for facilitating playing with the paddle.

BACKGROUND OF THE INVENTION

The field of amusement devices: games are technologically important to several industries, business organizations, and/or individuals.

Pickleball is a racquet sport (game) played with paddles and a perforated plastic ball on a court similar to a tennis court, but $1/3^{rd}$ the size. Existing pickleball paddles are deficient with regard to several aspects. For instance, current pickleball paddles include surface grit material (either grit paint or so-called "raw" carbon fiber or some kind of textured material) that gets worn out fairly quickly upon impact by a pickleball because the pickleball is made of hard plastic, and the edges of the holes in a pickleball are often sharp contributing to the damage of the surface material. Further, current pickleball paddles do not allow a user to replace the surface grit material, so the user has to just throw the paddle away and buy another paddle. This incurs additional costs and is environmentally unsound since the paddles go into landfill. Further, current pickleball paddles that use a raw carbon sheet as the outside layer are very expensive. In addition, the raw carbon sheet immediately starts breaking as the woven carbon fibers slowly tear and the pickleball paddle loses its effectiveness.

Therefore, there is a need for an improved playing implement for a paddle for facilitating playing with the paddle that may overcome one or more of the above-mentioned problems and/or limitations.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

Disclosed herein is a playing implement for a paddle for facilitating playing with the paddle, in accordance with some embodiments. Accordingly, the playing implement may include a surface plate. Further, the surface plate may be comprised of at least one layer of material. Further, the surface plate may be configured to be removably attached to a core portion of the paddle using at least one adhesive. Further, the at least one adhesive may be applied on an inner side of the surface plate. Further, the surface plate has a shape corresponding to a core shape of the core portion. Further, the surface plate may include a playing surface on an outer side of the surface plate. Further, the outer side opposes the inner side.

Further disclosed herein is a playing implement for a paddle for facilitating playing with the paddle, in accordance with some embodiments. Accordingly, the playing implement may include a surface plate. Further, the surface plate may be comprised of at least one layer of material. Further, the surface plate may include a layer of at least one adhesive on an inner side of the surface plate. Further, the layer of the at least one adhesive facilitates removably attaching the surface plate to a core portion of the paddle using the at least one adhesive. Further, the surface plate has a shape corresponding to a core shape of the core portion. Further, the surface plate may include a playing surface on an outer side of the surface plate. Further, the outer side opposes the inner side.

Further disclosed herein is a paddle with a playing implement for facilitating playing with the paddle, in accordance with some embodiments. Accordingly, the paddle may include a core portion, a handle, and the playing implement. Further, the handle may be connected to the core portion. Further, the playing implement may include a surface plate. Further, the surface plate may be comprised of at least one layer of material. Further, the surface plate may be configured to be removably attached to the core portion of the paddle using at least one adhesive. Further, the at least one adhesive may be applicable on an inner side of the surface plate. Further, the surface plate has a shape corresponding to a core shape of the core portion. Further, the surface plate may include a playing surface on an outer side of the surface plate. Further, the outer side opposes the inner side.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAIL DESCRIPTIONS OF THE INVENTION

Figure 1:
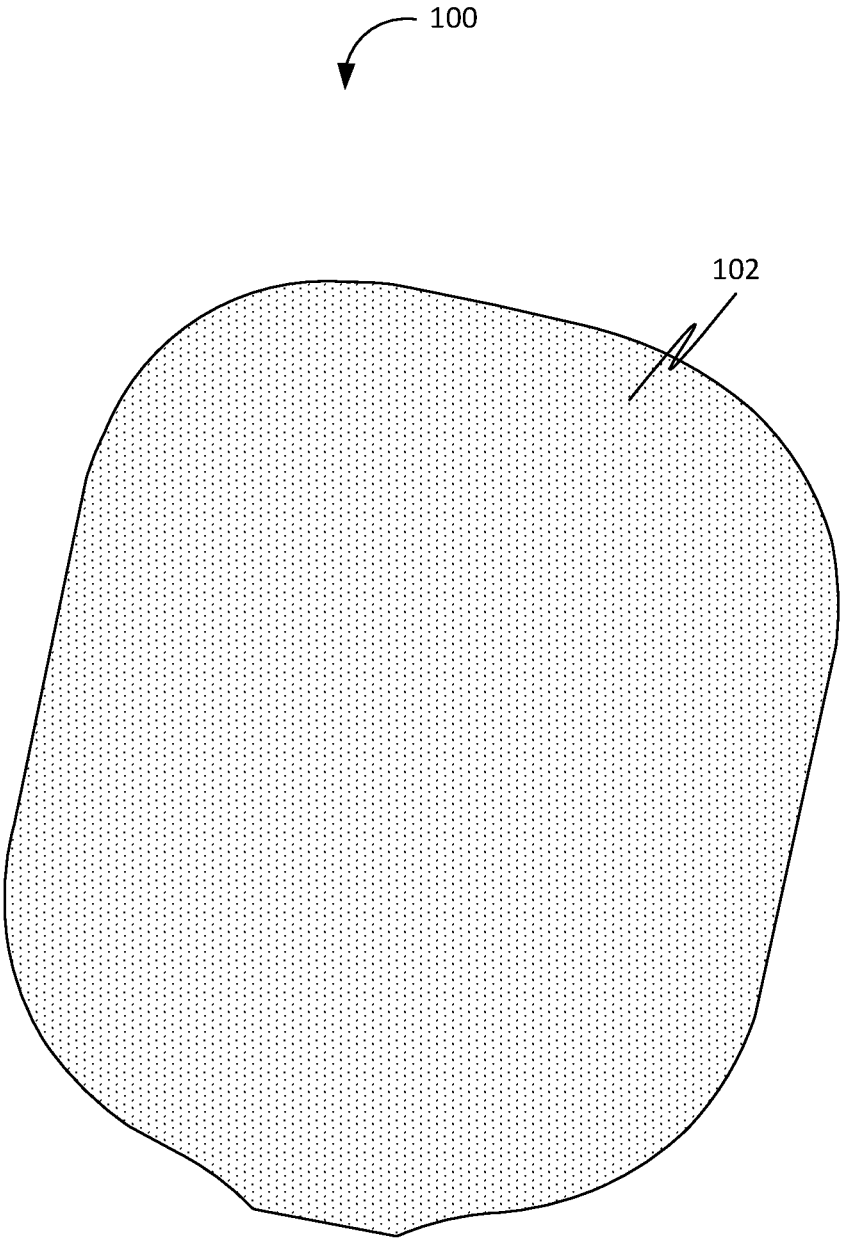
FIG. 1 is a front view of a playing implement 100 comprising a textured surface plate 102 for a paddle for facilitating playing with the paddle, in accordance with some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of a playing implement for a paddle for facilitating playing with the paddle, embodiments of the present disclosure are not limited to use only in this context.

Overview:

The present disclosure describes a playing implement for a paddle for facilitating playing with the paddle.

Further, the present disclosure describes a pickleball paddle with a replaceable pickleball paddle surface. Further, the replaceable pickleball paddle surface may be detachably attachable to an outer surface of a pickleball paddle base of a pickleball paddle using at least one adhesive. Further, the replaceable pickleball paddle surface may include a self-adhesive textured sticker sheet (for example, textured carbon fiber, textured fiberglass, or textured Kevlar). Further, the self-adhesive textured sticker sheet may get removed/replaced with ease.

Further, the pickleball paddle base may be made up of carbon fiber, plastic, wood, fiberglass, aluminum, polypropylene, Nomex, EVA foam, or some combination of these and other ingredients. Further, the at least one adhesive may be authorized by a sports governing body/organization (such as USA Pickleball Association). Further, the at least one adhesive may include water-based glue. Further, the water-based glue may include water, polymers, and additives. Further, in some embodiments, the at least one adhesive may include self-adhesive sheets. Further, the outside surface of the pickleball paddle may be serviceable using the replaceable pickleball paddle surface (similar to the strings in a tennis racket), so instead of throwing away the pickleball paddle, a user (a player or a service professional) may simply peel off the outer surface and add/attach a brand new sheet of the replaceable pickleball paddle surface backed with the at least one adhesive. Further, the pickleball paddle may include a grip and an end cap. Further, in some embodiments, the replaceable pickleball paddle surface may include a plurality of layers detachably attached to each other. Further, the plurality of layers may conform to standards of the US Pickleball Association. Further, the plurality of layers may include a core layer and a surface texture layer. Further, the surface texture layer may be positioned above the core layer. Further, the plurality of layers may include an external graphic layer positioned above the surface texture layer.

Further, in some embodiments, the external graphic layer may include a colored sheet of a solid color. Further, in an embodiment, the external graphic layer may include a custom graphic sheet comprising a customized graphic content that a player may want to use or show. Further, the customized graphic content may include a textual content, an image content, etc.

Further, in some embodiments, the core layer may be comprised of at least one of aluminum, polypropylene, Nomex, EVA foam, Kevlar, etc.

Further, in some embodiments, the surface texture layer may be comprised of one of carbon fiber, graphite, Kevlar, and fiberglass composite. Each of the compositions of the surface texture layer may possess characteristics that, when combined with the core layer, give each pickleball paddle the performance profile that suits an individual player's unique style and game. Further, the at least one surface texture may be authorized by a sports governing body/organization (such as USA Pickleball Association). Further, the surface texture layer may be enhanced by the use of a peel-ply, a removable non-stick mesh that creates a texture in the surface material (for example, resin) when it is removed.

Further, in some embodiments, the replaceable pickleball paddle surface may include the plurality of layers stacked one over the other. Further, the player may mix and match one or more layers from the plurality of layers based on a gaming style and attach two or more layers from the plurality of layers on the pickleball paddle base. Further, the gaming style may include an aggressive style, a defensive style, and so on. Further, in an instance, a first player having an aggressive gameplay may use the replaceable pickleball paddle surface in a first configuration. Further, the first configuration may include a first core layer from the core layer and a first surface texture layer of the surface texture layer. Further, the first core layer and the first surface texture layer may support the first player to play the pickleball game aggressively. Further, in the first configuration, the replaceable pickleball paddle surface may provide an aggressive surface with more friction. Further, in another instance, a second player having a defensive gameplay may use the replaceable pickleball paddle surface in a second configuration. Further, the second configuration may include a second core layer from the core layer and a second surface texture layer of the surface texture layer. Further, the second core layer and the second surface texture layer may support the second player to play the pickleball game defensively. Further, in the second configuration, the replaceable pickleball paddle surface may provide less friction but harder material. Further, the replaceable pickleball paddle surface may be used in different configurations based on the requirements of a game condition.

Further, in some embodiments, the replaceable pickleball paddle surface may include an edge guard disposed along a periphery of the replaceable pickleball paddle surface. Further, the edge guard may be configured for protecting the replaceable pickleball paddle surface from wear and tear caused by unwanted external physical impacts (such as accidental falls, striking on walls, throwing, etc.).

Further, in some embodiments, the replaceable pickleball paddle surface may include a lead tape along portions of a periphery of the edge guard that can increase the pickleball paddle's weight, power, and stability. Further, in some embodiments, the lead tape may be covered with an electrical tape. Further, the electrical tape may hide a reflective surface associated with the lead tape according to standards of USAPA. Further, the electrical tape may prevent the lead tape from coming off.

Further, in some embodiments, the player may attach the lead tape only on some portions (such as a head, near handle, sides, and corners) of the periphery of the edge guard based on a player preference. Further, the player preference may be based on weight of the pickleball paddle with which the player may want to play. Further, in an instance, if the player wants to play with a pickleball paddle having a heavy head, the player may add the lead tape to a head portion of the periphery of the edge guard. Further, in another instance, the player may add the lead tape to vertical side portions of the periphery of the edge guard to provide stability to the pickleball paddle upon impact by the game ball.

Further, in some embodiments, the replaceable pickleball paddle surface may include at least one preformed cutout. Further, the player may remove at least one preformed cutout present in the replaceable pickleball paddle surface. Further, at least one cavity may be formed due to removal of the at least one preformed cutout. Further, the player may insert at least one strip (comprising the enhancing material) in the at least one cavity. Further, the at least one strip may be attached to the pickleball paddle using an adhesive that may be applied on a rear surface of the at least one strip. Further, the at least one strip may be characterized by a geometrical shape. Further, the at least one strip may be used as sticker. Further, the at least one strip may include self-adhesive sheets for attaching the at least one strip to the replaceable pickleball paddle surface.

In further embodiments, a pickleball kit for customizing and repairing the pickleball paddle is disclosed. Further, the pickleball kit may include the replaceable pickleball paddle surface, the at least one adhesive, the at least one strip, at least one adhesive applicator, and a removal tool. Further, the at least one strip may be characterized by a geometrical shape. Further, the geometrical shape may include a rectangle, a square, a circle, etc. Further, the removal tool may include a rubber chip, a metal chip, etc. Further, the removal tool may assist the player to remove a first replaceable pickleball paddle surface that may be worn out due to playing. Further, the removal tool may assist the player to remove adhesive or glue already used for pasting the first replaceable pickleball paddle surface on the pickleball paddle base. Further, the at least one adhesive applicator may include a sponge and a clamp that may be used to securing the sponge (or rubber sponge). Further, the clamp may be held by the player. Further, the at least one adhesive applicator may be used for assisting the player in applying the at least one adhesive on the pickleball paddle base for attaching a new replaceable pickleball paddle surface.

Further, the pickleball paddle may be serviceable by removing a first replaceable pickleball paddle surface attached to a core portion (core) of the pickleball paddle from the core portion and attaching a second replaceable pickleball paddle surface to the core portion. Further, the second replaceable pickleball paddle surface may be attached to either face of the core portion.

Further, the present disclosure relates generally to racquet sports. More specifically, the present disclosure describes a replaceable pickleball paddle surface.

Further, the present disclosure describes a replaceable pickleball paddle surface. Further, the replaceable pickleball surface may include a surface sheet (a carbon fiber surface sheet) and an adhesive applied directly to the carbon fiber surface sheet in a factory where the replaceable pickleball paddle surface is manufactured. Further, the adhesive pattern is die cut to match directly with the shape of the carbon fiber surface sheet in the factory and they are assembled together in the factory.

Further, the present disclosure describes a pickleball paddle with a replaceable pickleball paddle surface. Further, the replaceable pickleball paddle surface may include a carbon fiber or additional textured material surface sheet. Further, the surface sheet is thin and textured. Further, the surface sheet may be comprised of layers of non-woven CFRP (Carbon Fiber Reinforced Polymers) such as unidirectional carbon fiber, or layers of woven CFRP, such as plain weave or twill weave carbon fiber, or woven/non-woven Kevlar or other aramids or combinations thereof. Further, the number of layers of CFRP or Kevlar or other aramids in the surface sheet may be any number but is usually 1, 2, 3, or 4. Further, the woven cloth (whether carbon fiber or other aramid filaments) can have many combinations of weaves—such as a twill weave, a plain weave, or a patterned weave.

Further, the carbon fiber surface sheet may be constructed by arranging unidirectional carbon fibers in different directions which are labeled in degrees and the directions indicate the orientation of the unidirectional carbon fibers. Further, the double layer of unidirectional carbon fiber may be constructed by arranging two layers of unidirectional carbon fibers arranged in a zero degree configuration for the first layer and a zero degree configuration for the second layer. Further, a triple layer of unidirectional carbon fiber may be constructed with filaments of a top and bottom layer of unidirectional carbon fiber of the three layers running in a zero degree configuration (parallel to each other) while filaments of the middle layer run in a ninety degree configuration (perpendicular to the outer layers). Further, a two layer the carbon fiber surface sheet may be properly formed when the filaments of the top layer of unidirectional carbon fiber run parallel to the filaments of the bottom layer of unidirectional carbon fiber.

Further, the carbon fiber surface sheet needs to have a texture. Further, a press is used to add texture to the carbon fiber surface sheet. Further, the press needs to be double-stacked for adding texture to the carbon fiber surface sheet. Further, the double stacking of the press may include placing a peel-ply film to create texture in an outer surface of a top carbon fiber surface sheet below a top plate of the press. Further, in a two layer configuration, a first layer unidirectional pre-preg carbon fiber cloth arranged at zero degrees is placed below the peel-ply film. Further, a second layer unidirectional pre-preg carbon fiber cloth arranged at zero degrees is placed below the first layer unidirectional pre-preg carbon fiber cloth. Further, a satin release film for creating a smooth surface on the opposite side of the outer surface of the top carbon fiber surface sheet is placed below the second layer unidirectional pre-preg carbon fiber cloth. Further, a foam caul plate is placed below the satin release film. Further, a satin release film for creating a smooth surface on an inner surface of a bottom carbon fiber surface sheet is placed below the satin release film. Further, a second layer unidirectional pre-preg carbon fiber cloth arranged at zero degrees is placed below the satin release film. Further, a first layer unidirectional pre-preg carbon fiber cloth arranged at zero degrees is placed below the second layer unidirectional pre-preg carbon fiber cloth. Further, a peel-ply film to create texture in an outer surface opposite to the inner surface of the bottom carbon fiber surface sheet is placed below the first layer unidirectional pre-preg carbon fiber cloth and above a bottom plate of the press. below a top plate of the press. Further, the double stacking of the press makes two carbon fiber surface sheets (top carbon fiber surface sheet and bottom carbon fiber surface sheet) at once. Further, the addition of the foam caul plate in the middle of the stack provides a uniform texture on the outer surface of the two carbon fiber surface sheets. Further, the satin release film creates a smooth finish on the inner surface opposite to the outer surface of the two carbon fiber surface sheets. Further, the smooth finish promotes adhesion.

Further, in a three layer configuration, a first layer unidirectional pre-preg carbon fiber cloth arranged at zero degrees is placed below the peel-ply film. Further, a second layer unidirectional pre-preg carbon fiber cloth arranged at ninety degrees is placed below the first layer unidirectional pre-preg carbon fiber cloth. Further, a third layer unidirectional pre-preg carbon fiber cloth arranged at zero degrees is placed below the second layer unidirectional pre-preg carbon fiber cloth. Further, a satin release film for creating a smooth surface on the opposite side of the outer surface of the top carbon fiber surface sheet is placed below the third layer unidirectional pre-preg carbon fiber cloth. Further, a foam caul plate is placed below the satin release film. Further, a satin release film for creating a smooth surface on an inner surface of a bottom carbon fiber surface sheet is placed below the satin release film. Further, a third layer unidirectional pre-preg carbon fiber cloth arranged at zero degrees is placed below the satin release film. Further, a second layer unidirectional pre-preg carbon fiber cloth arranged at ninety degrees is placed below the third layer unidirectional pre-preg carbon fiber cloth. Further, a first layer unidirectional pre-preg carbon fiber cloth arranged at zero degrees is placed below the second layer unidirectional pre-preg carbon fiber cloth. Further, a peel-ply film to create texture in an outer surface opposite to the inner surface of the bottom carbon fiber surface sheet is placed below the first layer unidirectional pre-preg carbon fiber cloth and above a bottom plate of the press. below a top plate of the press. Further, the double stacking of the press makes two carbon fiber surface sheets (top carbon fiber surface sheet and bottom carbon fiber surface sheet) at once. Further, the addition of the foam caul plate in the middle of the stack provides a uniform texture on the outer surface of the three carbon fiber surface sheets. Further, the satin release film creates a smooth finish on the inner surface opposite to the outer surface of the three carbon fiber surface sheets. Further, the smooth finish promotes adhesion.

Further, the replaceable pickleball paddle surface may include a differential adhesive. Further, the differential adhesive may be used to facilitate the removable of the replaceable pickleball paddle surface from the pickleball paddle by a user without separating the inner surface of the carbon fiber surface sheet from the adhesive and without leaving any adhesive residue of the adhesive on the exterior surface of the pickleball paddle. Further, the differential has a different bond strength on one side versus another. Further, the differential adhesive may be similar to a double-sided tape where one side of the tape has a very high shear/peel strength and is very difficult to remove and the other side of the tape has a lower shear strength and is easier to remove. Further, the differential adhesive may be a repositionable tape by 3M, for example product 9425HT. Further, the differential adhesive requires that the surface to which the differential adhesive is bonded should be as smooth as possible. Further, the differential adhesive needs to be extremely thin to meet the rules for paddle deflection associated with the USA Pickleball Association. Further, the differential adhesive may also be a pressure sensitive adhesive (PSA). Further, the PSA may make the bond between the replaceable pickleball paddle surface and the exterior surface of the pickleball stronger with every hit of balls on the pickleball paddle. Further, the PSA may reduce the sound produced when balls hit the pickleball paddle, therefore, making the pickleball paddle quieter.

Further, the replaceable pickleball paddle surface may include a pull tab. Further, the pull tab is a small tab that a user may "pull" with their fingers. Further, the pull tab may be used for removing the replaceable pickleball paddle surface from a backing paper. Further, the replaceable pickleball paddle surface is attached to the backing paper. Further, the user may use the pull tab to easily peel the replaceable pickleball paddle surface away from the backing paper (brown paper) without having to hold/touch any glue or adhesive. Further, the pull tab may be used for removing the replaceable pickleball paddle surface from the pickleball paddle. When the user wants to replace the replaceable pickleball paddle surface the user may grab the pull-tab again and peel the replaceable pickleball paddle surface away from the pickleball paddle again without having to hold/touch any glue.

Figure 2:
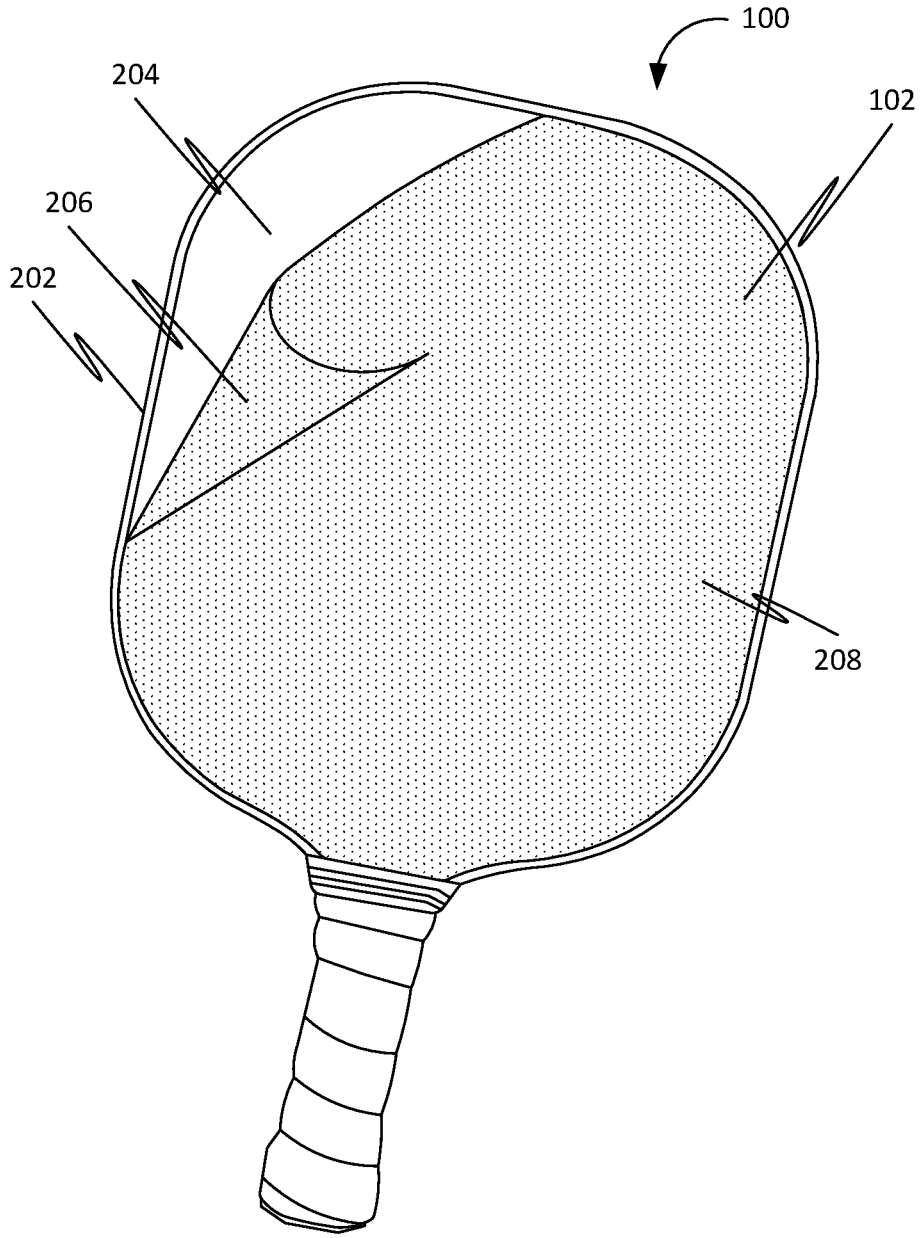
FIG. 2 is a front view of the playing implement 100 attached to a paddle 202 with the paddle 202, in accordance with some embodiments.
Figure 3:
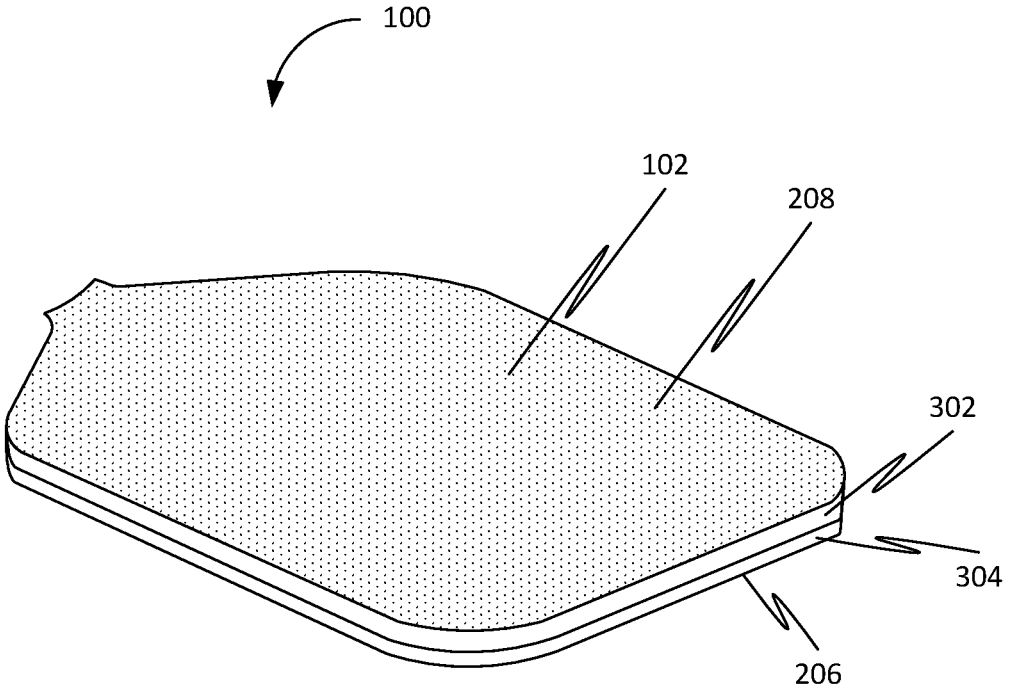
FIG. 3 is a top perspective view of the playing implement 100, in accordance with some embodiments.

FIG. 1 is a front view of a playing implement 100 comprising a textured surface plate 102 for a paddle 202 (as shown in FIG. 2) for facilitating playing with the paddle 202, in accordance with some embodiments. Further, the playing implement 100 may include a surface plate 102. Further, the surface plate 102 may be comprised of at least one layer of material 302, as shown in FIG. 3. Further, the surface plate 102 may be the textured surface plate 102. Further, the surface plate 102 may be configured to be removably attached to a core portion 204, as shown in FIG. 2, of the paddle 202 using at least one adhesive. Further, the at least one adhesive may be applicable on an inner side 206, as shown in FIG. 2, of the surface plate 102. Further, the surface plate 102 has a shape corresponding to a core shape of the core portion 204. Further, the surface plate 102 may include a playing surface on an outer side 208, as shown in FIG. 2, of the surface plate 102. Further, the outer side 208 opposes the inner side 206. Further, the surface plate 102 may include a replaceable pickleball paddle surface. Further, the surface plate 102 may include a self-adhesive textured sticker sheet. Further, the paddle 202 may include a pickleball paddle. Further, the core portion 204 may include a core layer and the at least one layer of material 302 may include a surface texture layer. Further, the surface plate 102 may be a face plate for the pickleball paddle. Further, the pickleball paddle may include a head and a handle. Further, the core shape of the core portion 204 corresponds to a shape of the head. Further, the replaceable pickleball paddle surface may include a plurality of layers. Further, the at least one layer of material 302 may include a layer of carbon fiber weave, a layer of graphite composite, or a layer of fiberglass or other composite material. Further, in some embodiments, the surface plate 102 may be configured for protecting the core portion 204 of the paddle 202. Further, the core portion 202 may be a base of the paddle 202. Further, the surface plate 102 may be a pickleball paddle protector. Further, the pickleball paddle protector may be removably attachable to the core portion of the paddle 204 using the at least one adhesive to form the playing surface.

Further, in some embodiments, the surface plate 102 may include a layer 304 of the at least one adhesive, as shown in FIG. 3, on the inner side 206 of the surface plate 102. Further, the layer 304 of the at least one adhesive facilitates removably attaching the surface plate 102 to the core portion 204.

Figure 4:
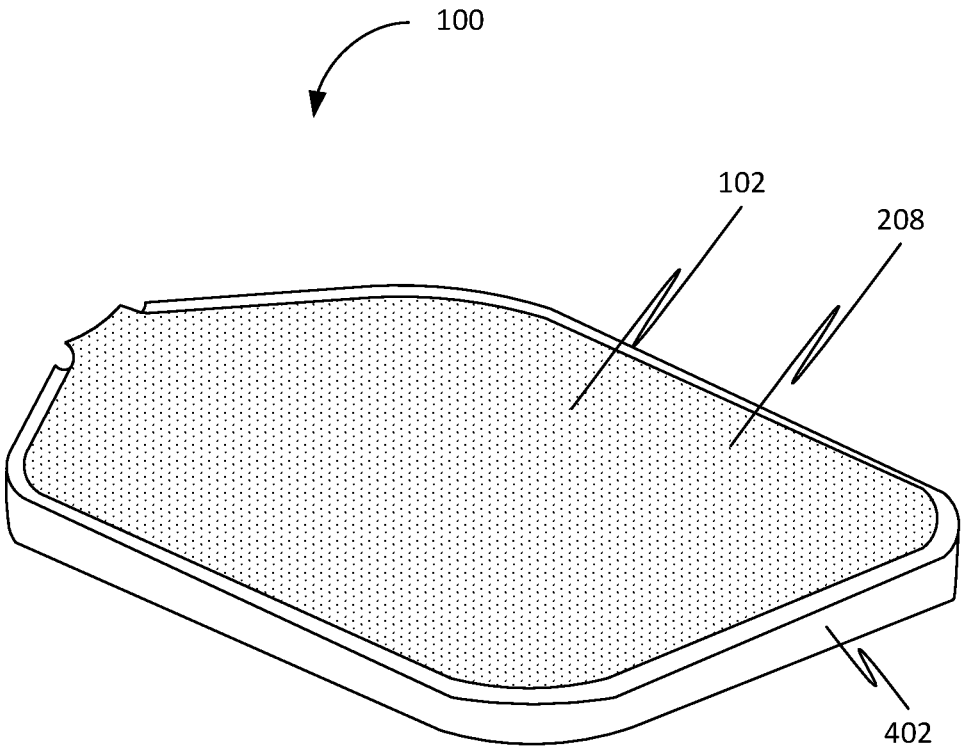
FIG. 4 is a top perspective view of the playing implement 100, in accordance with some embodiments.

In further embodiments, the playing implement 100 may include an edge guard 402, as shown in FIG. 4, configured to be peripherally disposed in at least a part around a head of the paddle 202. Further, the head may include the surface plate 102 and the core portion 204. Further, the edge guard 402 may be comprised of at least one material. Further, the at least one material of the edge guard 402 absorbs an impact force imparted on the edge guard 402 for protecting the surface from the impact force. Further, the at least one material may include an impact absorbing material. Further, the at least one material may include acrylicbase resins, silicon base resins, polyurethane, etc.

Figure 5:
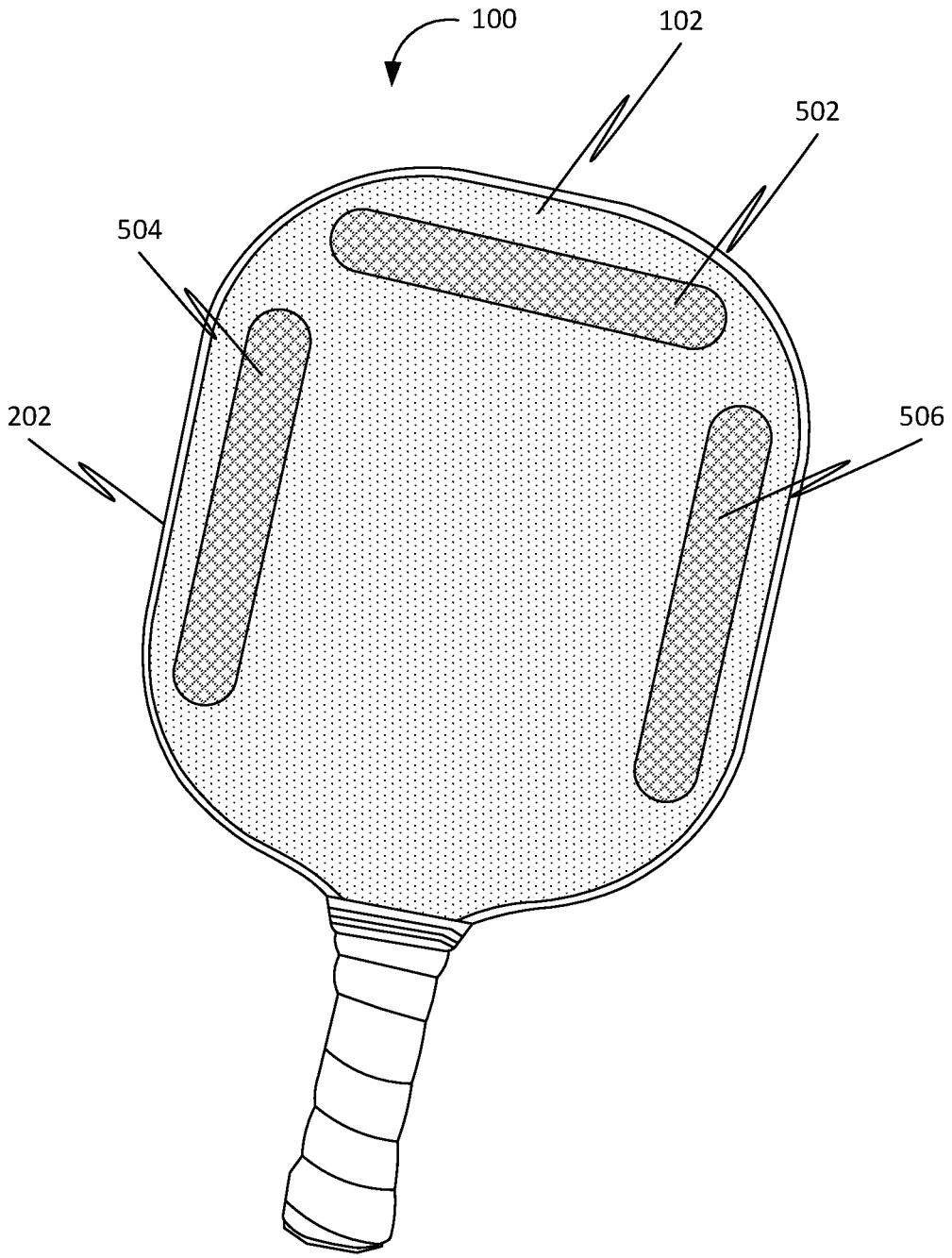
FIG. 5 is a front view of the playing implement 100 attached to the paddle 202 with the paddle 202, in accordance with some embodiments.

Further, in some embodiments, the surface plate 102 may include at least one plate portion 502-506, as shown in FIG. 5, in at least one location on the surface plate 102. Further, the at least one plate portion 502-506 may be comprised of at least one first layer of material disparate from the at least one layer of material 302. Further, the at least one first layer of material may include metal, wood, etc.

Further, in some embodiments, the at least one layer of material may be comprised of at least one of carbon fiber, graphite, fiberglass, Kevlar, and composite materials.

Figure 7:
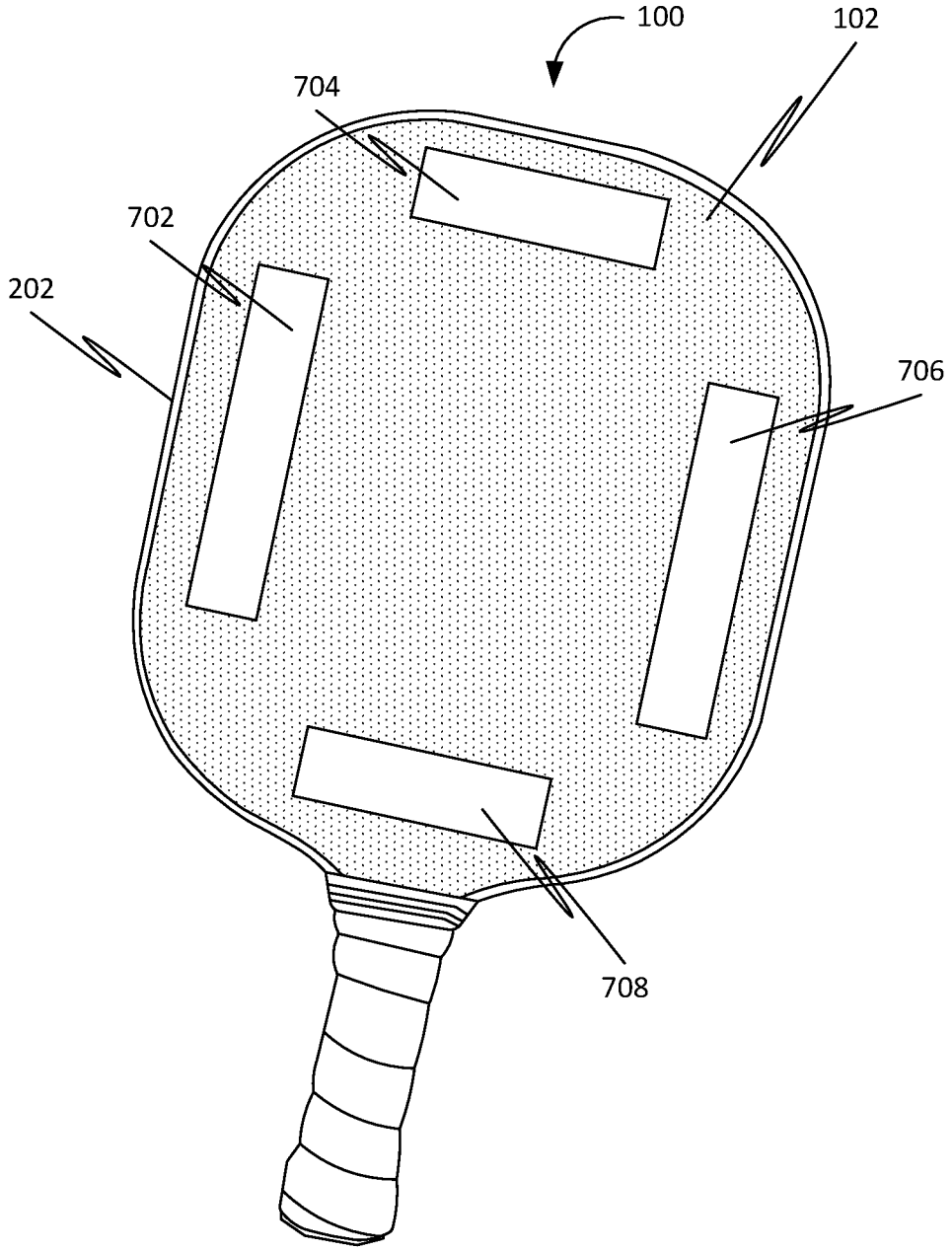
FIG. 7 is a front view of the playing implement 100 attached to the paddle 202 with the paddle 202, in accordance with some embodiments.

Further, in some embodiments, the surface plate 102 defines at least one cavity 702-708, as shown in FIG. 7, in at least one location on the surface plate 102.

Figure 8:
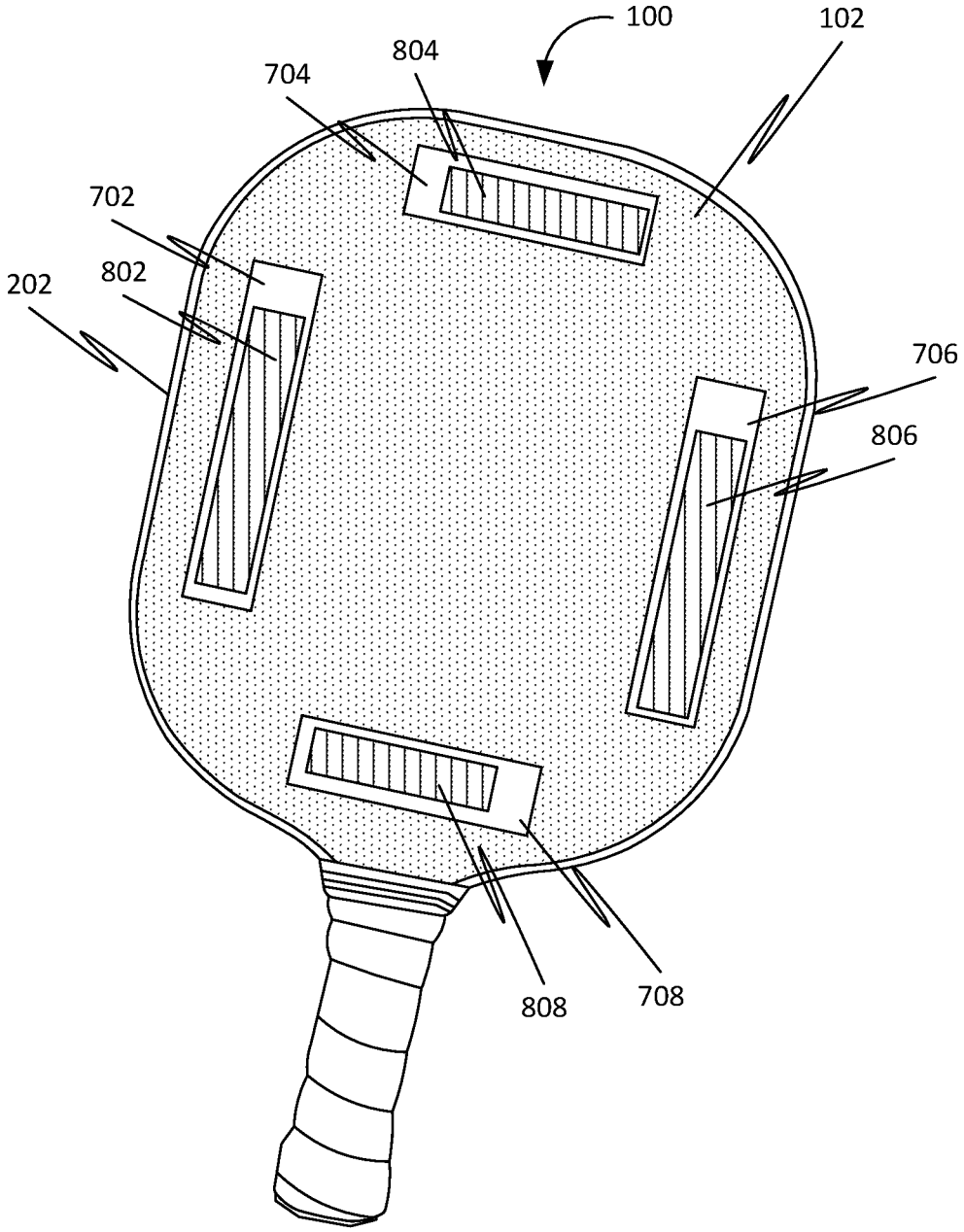
FIG. 8 is a front view of the playing implement 100 attached to the paddle 202 with the paddle 202, in accordance with some embodiments.

In an embodiment, the playing implement 100 may include at least one additional plate portion 802-808, as shown in FIG. 8. Further, the at least one additional plate portion 802-808 may be configured to be disposed in the at least one cavity 702-708 in the at least one location based on the removing. Further, the at least one additional plate may be comprised of at least one first layer of material disparate from the at least one layer of material 302. Further, the at least one additional plate portion 802-808 may be at least one strip.

Figure 9:
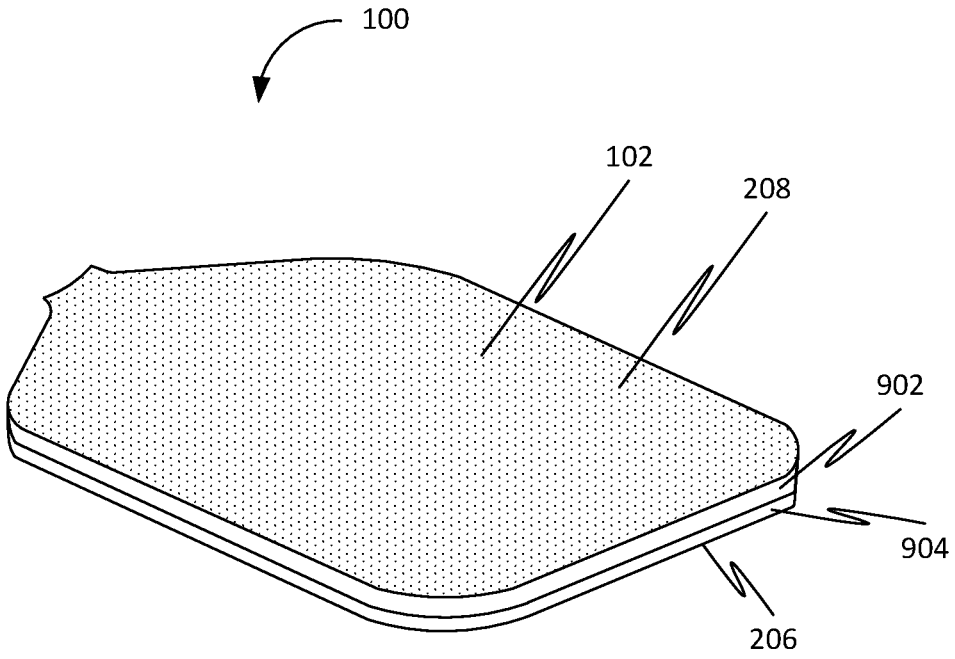
FIG. 9 is a top perspective view of the playing implement 100, in accordance with some embodiments.

Further, in some embodiments, the at least one layer of material 302 may include a first layer of material 902 and a second layer of material 904, as shown in FIG. 9. Further, the first layer of material 902 forms the playing surface and the second layer of material 904 may be disposed adjacent to the first layer of material 902. Further, the second layer of material 904 may be colored at least one color. Further, the second layer of material 904 may be exposed on the playing surface based on removing at least a portion of the first layer of material 902. Further, the first layer of material 902 may include a layer of carbon fiber material, a layer of graphite composite, or a layer of fiberglass composite or other composite materials. Further, the second layer of material 904 may include a pigment layer of the at least one color. Further, the at least one color may be a bright color.

FIG. 2 is a front view of the playing implement 100 attached to the paddle 202 with the paddle 202, in accordance with some embodiments.

FIG. 3 is a top perspective view of the playing implement 100, in accordance with some embodiments.

FIG. 4 is a top perspective view of the playing implement 100, in accordance with some embodiments.

FIG. 5 is a front view of the playing implement 100 attached to the paddle 202 with the paddle 202, in accordance with some embodiments.

Figure 6:
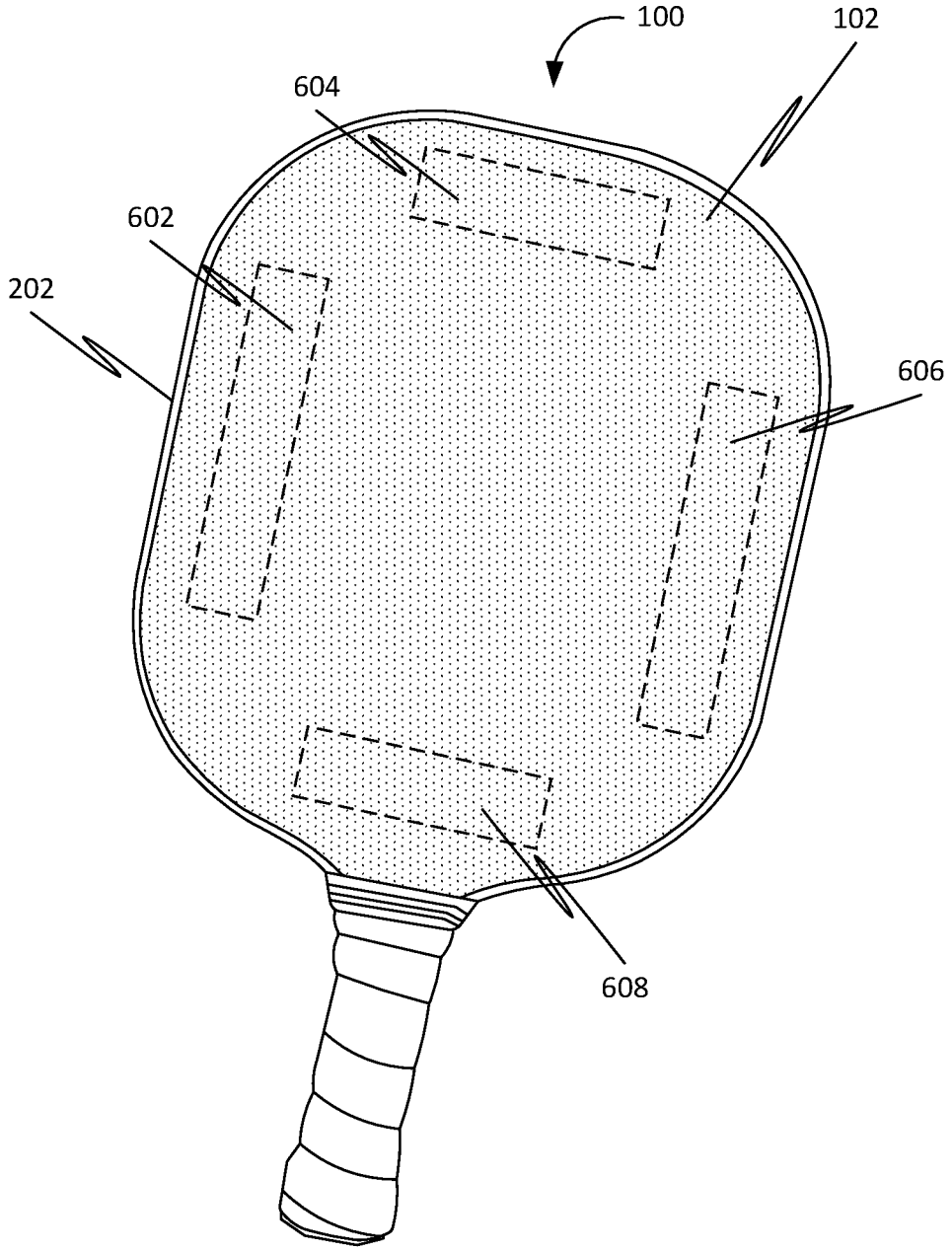
FIG. 6 is a front view of the playing implement 100 attached to the paddle 202 with the paddle 202, in accordance with some embodiments.

FIG. 6 is a front view of the playing implement 100 attached to the paddle 202 with the paddle 202, in accordance with some embodiments.

FIG. 7 is a front view of the playing implement 100 attached to the paddle 202 with the paddle 202, in accordance with some embodiments.

FIG. 8 is a front view of the playing implement 100 attached to the paddle 202 with the paddle 202, in accordance with some embodiments.

FIG. 9 is a top perspective view of the playing implement 100, in accordance with some embodiments.

Figure 10:
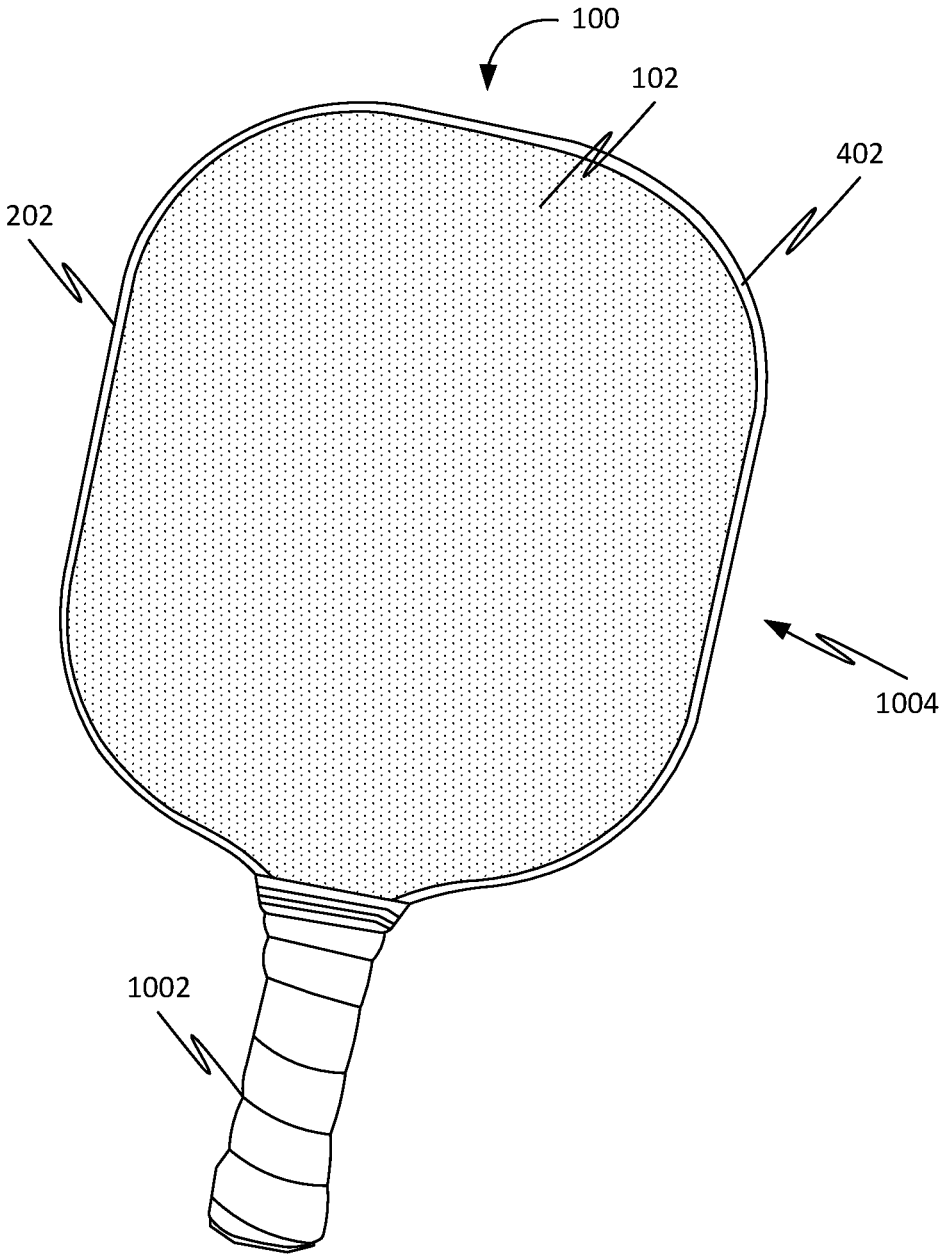
FIG. 10 is a front view of the paddle 202 with the playing implement 100, in accordance with some embodiments.

FIG. 10 is a front view of the paddle 202 with the playing implement 100, in accordance with some embodiments. Further, the paddle 202 may include a head 1004 and a handle 1002 coupled with the head 1004.

Figure 11:
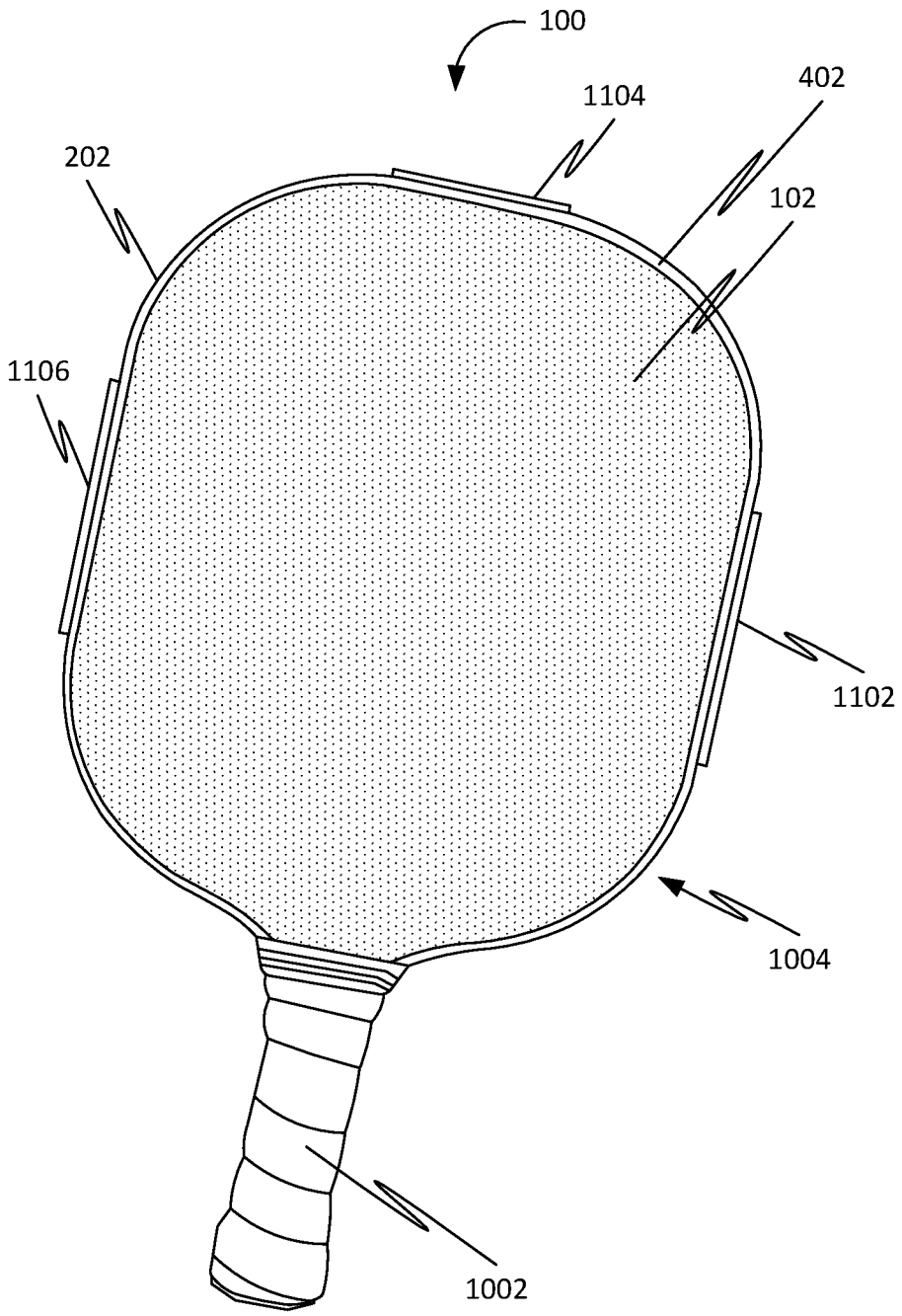
FIG. 11 is a front view of the playing implement 100 attached to the paddle 202 with the paddle 202, in accordance with some embodiments.

FIG. 11 is a front view of the playing implement 100 attached to the paddle 202 with the paddle 202, in accordance with some embodiments. Further, the playing implement 100 may include at least one lead tape 1102-1106.

Figure 12:
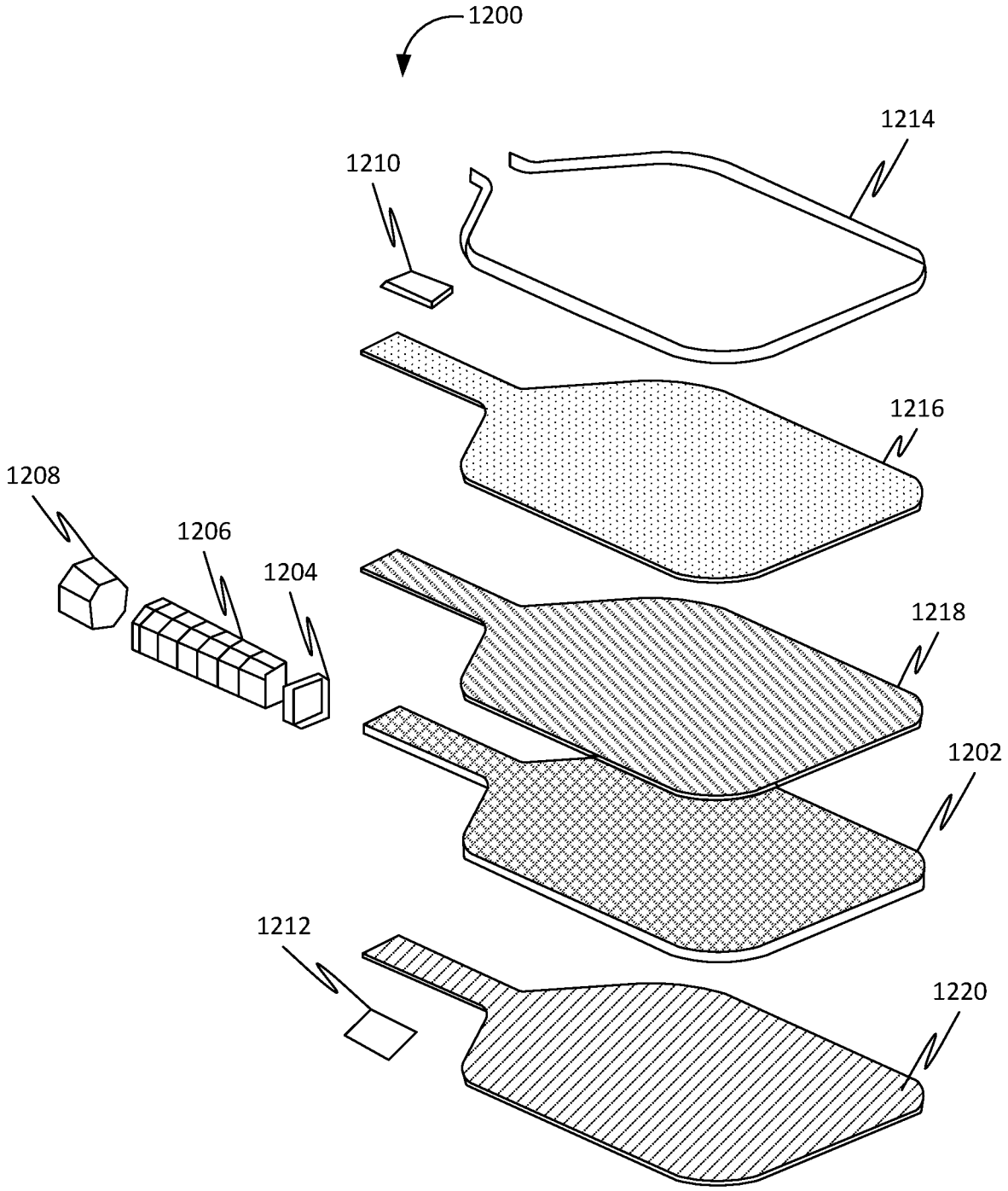
FIG. 12 is an exploded view of a paddle 1200 with a playing implement, in accordance with some embodiments.

FIG. 12 is an exploded view of a paddle 1200 with a playing implement, in accordance with some embodiments. Further, the paddle 1200 may include a core 1202, a rubber band 1204, a grip 1206, an end cap 1208, and pallets 1210-1212. Further, the playing implement may include an edge guard 1214, a graphic layer 1216, and surface plates 1218-1220.

Figure 13:
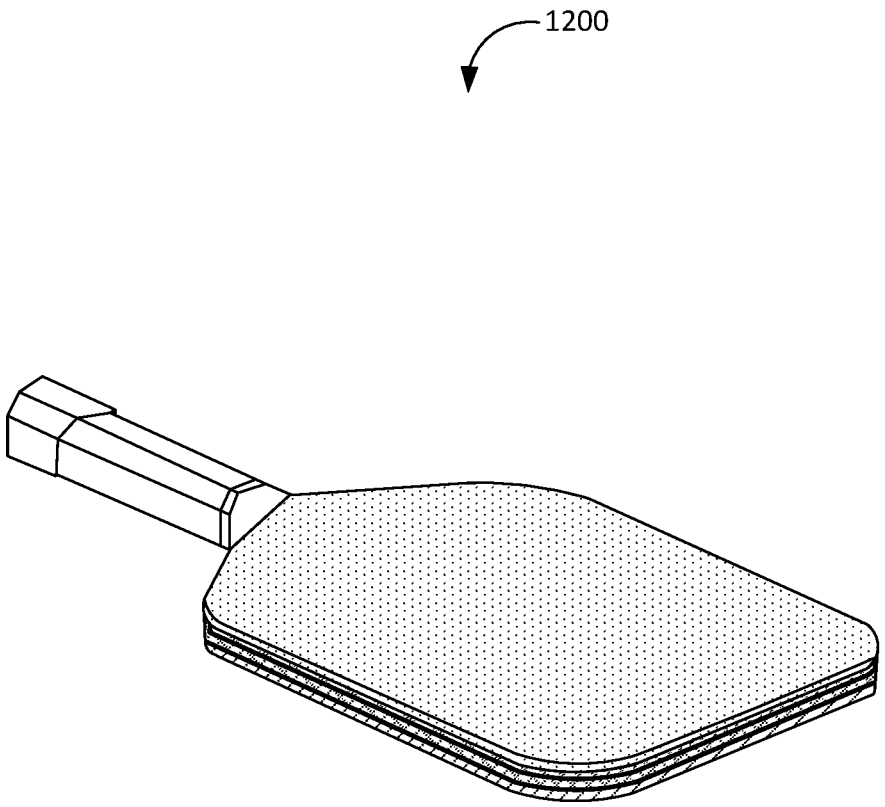
FIG. 13 is a top perspective view of the paddle 1200 with the playing implement, in accordance with some embodiments.

FIG. 13 is a top perspective view of the paddle 1200 with the playing implement, in accordance with some embodiments.

Figure 14:
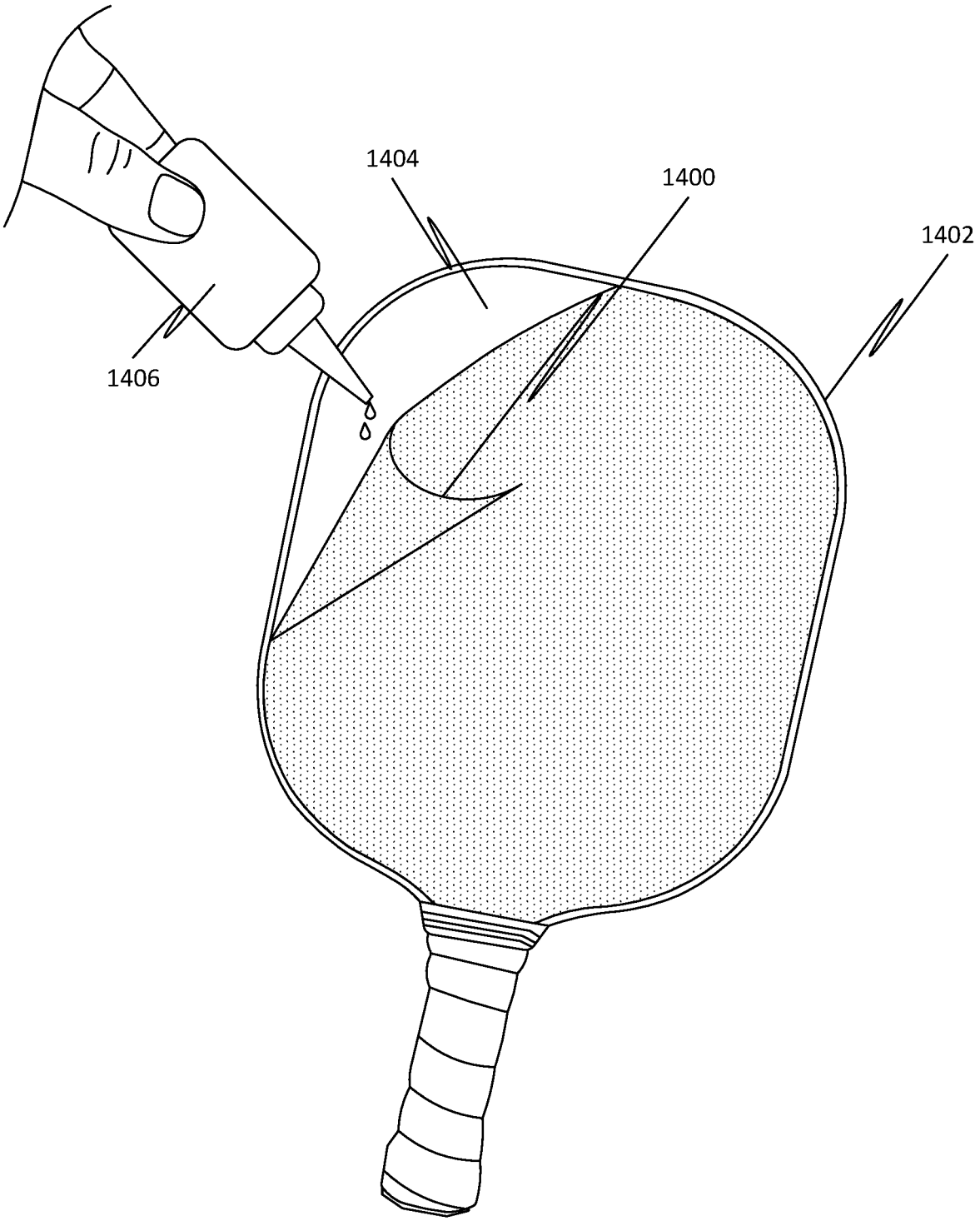
FIG. 14 is a front view of a surface plate 1400 attachable to a paddle 1402 with the paddle 1402, in accordance with some embodiments.

FIG. 14 is a front view of a surface plate 1400 attachable to a paddle 1402 with the paddle 1402, in accordance with some embodiments. Further, the surface plate 1400 may be attached to a core portion 1404 of the paddle 1402 using an adhesive dispensed from an adhesive container 1406.

Figure 15:
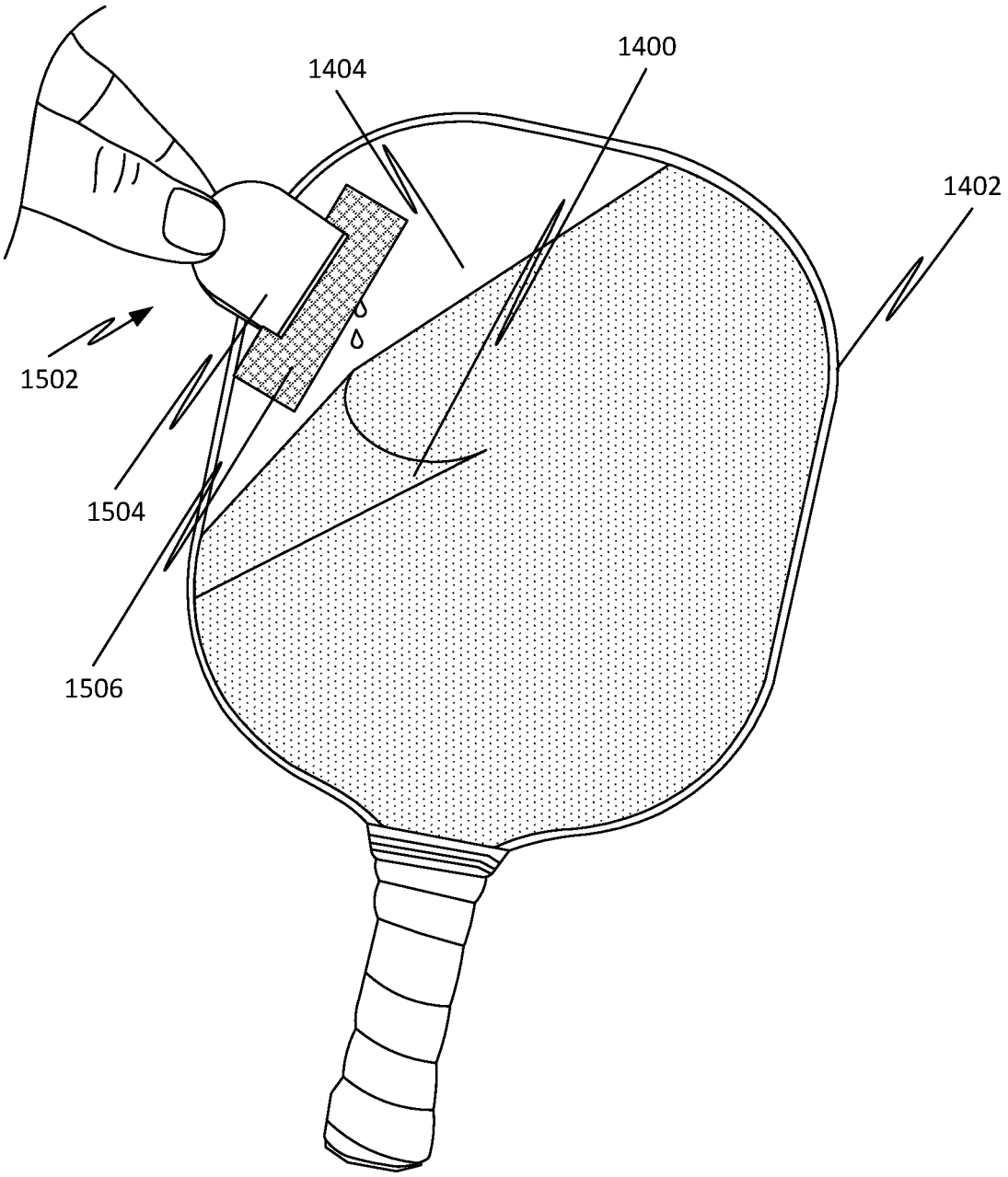
FIG. 15 is a front view of the surface plate 1400 attachable to the paddle 1402 with the paddle 1402, in accordance with some embodiments.

FIG. 15 is a front view of the surface plate 1400 attachable to the paddle 1402 with the paddle 1402, in accordance with some embodiments. Further, the adhesive dispensed may be applied using an adhesive applicator 1502. Further, the adhesive applicator 1502 may include a clamp 1504 and a sponge 1506.

Figure 16:
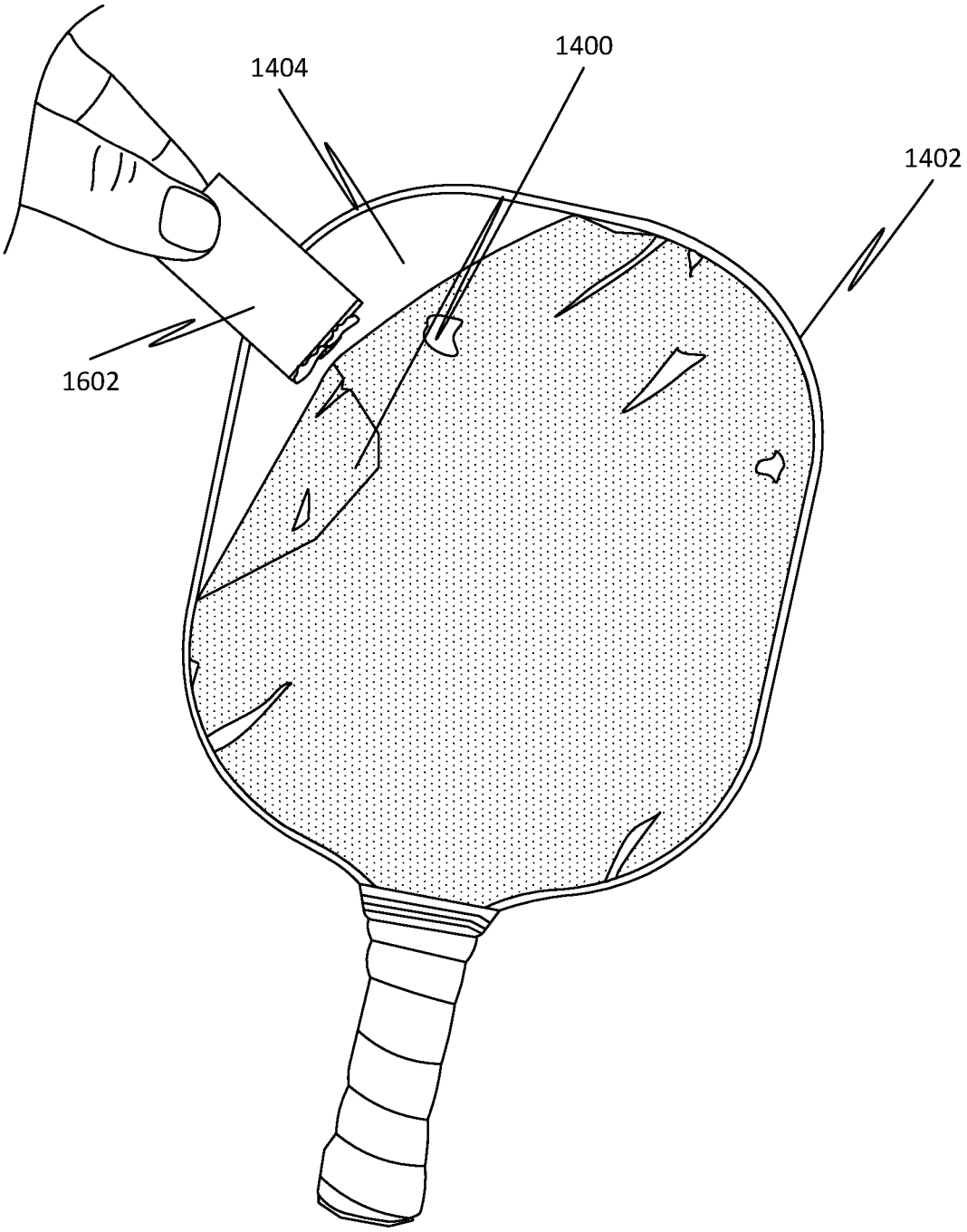
FIG. 16 is a front view of the surface plate 1400 attachable to the paddle 1402 with the paddle 1402, in accordance with some embodiments.

FIG. 16 is a front view of the surface plate 1400 attachable to the paddle 1402 with the paddle 1402, in accordance with some embodiments. Further, the surface plate 1400 may be removed from the core portion 1404 using a removal tool 1602.

Figure 17:
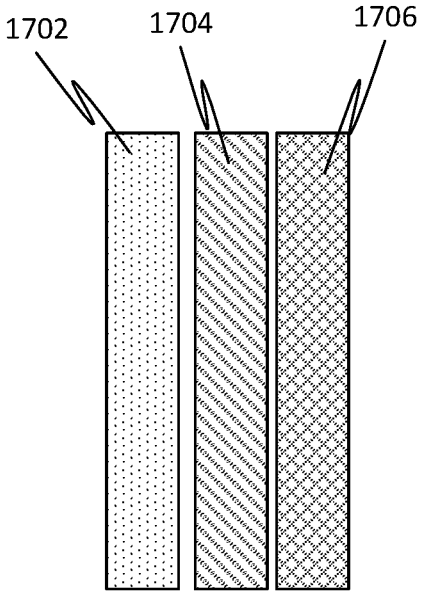
FIG. 17 is a front view of at least one strip 1702-1706 of the surface plate 1400 in accordance with some embodiments.

FIG. 17 is a front view of at least one strip 1702-1706 of the surface plate 1400 in accordance with some embodiments.

Figure 18:
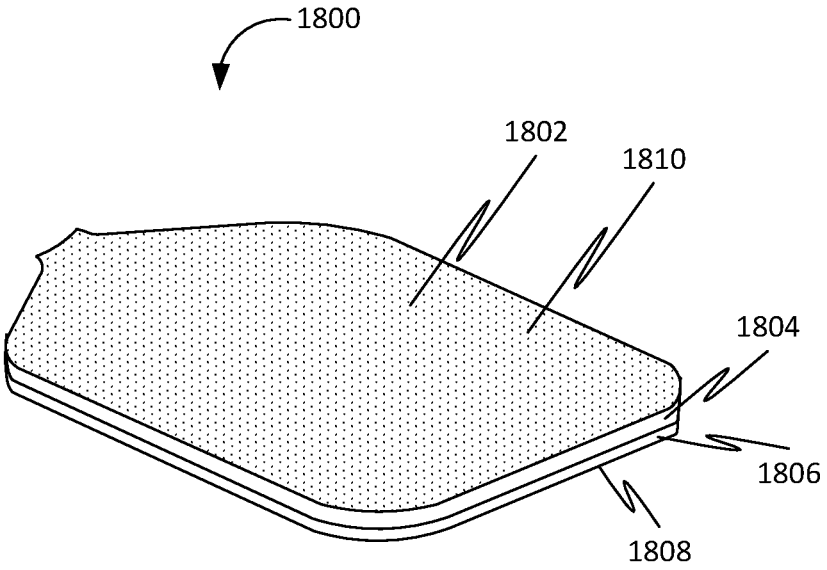
FIG. 18 is a front view of a playing implement 1800 for a paddle for facilitating playing with the paddle, in accordance with some embodiments.

FIG. 18 is a front view of a playing implement 1800 for a paddle for facilitating playing with the paddle, in accordance with some embodiments. Further, the playing implement 1800 may include a surface plate 1802. Further, the surface plate 1802 may be comprised of at least one layer of material 1804. Further, the surface plate 1802 may include a layer 1806 of at least one adhesive on an inner side 1808 of the surface plate 1802. Further, the layer 1806 of the at least one adhesive facilitates removably attaching the surface plate 1802 to a core portion of the paddle using the at least one adhesive. Further, the surface plate 1802 has a shape corresponding to a core shape of the core portion. Further, the surface plate 1802 may include a playing surface on an outer side 1810 of the surface plate 1802. Further, the outer side 1810 opposes the inner side 1808.

In further embodiments, the playing implement 1800 may include an edge guard configured to be peripherally disposed in at least a part around a head of the paddle. Further, the head may include the surface plate 1802 and the core portion. Further, the edge guard may be comprised of at least one material. Further, the at least one material of the edge guard absorbs an impact force imparted on the edge guard for protecting the surface from the impact force.

Further, in some embodiments, the surface plate 1802 may include at least one plate portion in at least one location on the surface plate 1802. Further, the at least one plate portion may be comprised of at least one first layer of material disparate from the at least one layer of material 1804.

Further, in some embodiments, the at least one layer of material may be comprised of at least one of carbon fiber, graphite, fiberglass, and composite materials.

Further, in some embodiments, the surface plate 1802 defines at least one cavity in at least one location on the surface plate 1802.

In an embodiment, the playing implement 1800 may include at least one additional plate portion. Further, the at least one additional plate portion may be configured to be disposed in the at least one cavity in the at least one location based on the removing. Further, the at least one additional plate may be comprised of at least one first layer of material disparate from the at least one layer of material 1804.

Figure 19:
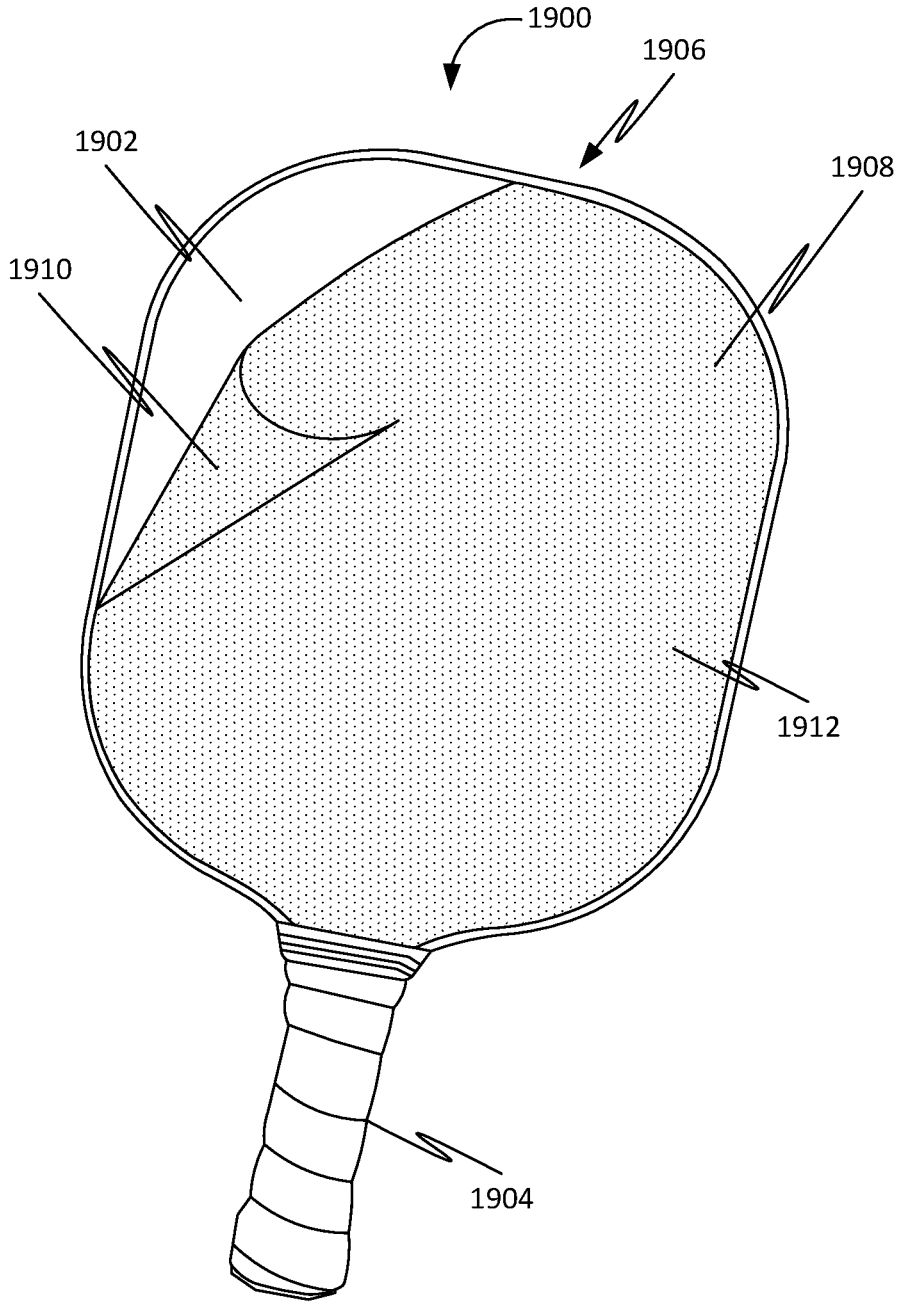
FIG. 19 is a front view of a paddle 1900 with a playing implement 1906 for facilitating playing with the paddle 1900, in accordance with some embodiments.

FIG. 19 is a front view of a paddle 1900 with a playing implement 1906 for facilitating playing with the paddle 1900, in accordance with some embodiments. Accordingly, the paddle 1900 may include a core portion 1902, a handle 1904, and the playing implement 1906.

Further, the handle 1904 may be connected to the core portion 1902.

Further, the playing implement 1906 may include a surface plate 1908. Further, the surface plate 1908 may be comprised of at least one layer of material. Further, the surface plate 1908 may be configured to be removably attached to the core portion 1902 of the paddle 1900 using at least one adhesive. Further, the at least one adhesive may be applicable on an inner side 1910 of the surface plate 1908. Further, the surface plate 1908 has a shape corresponding to a core shape of the core portion 1902. Further, the surface plate 1908 may include a playing surface on an outer side 1912 of the surface plate 1908. Further, the outer side 1912 opposes the inner side 1910.

Further, in some embodiments, the surface plate 1908 may include a layer of the at least one adhesive on the inner side 1910 of the surface plate 1908. Further, the layer of the at least one adhesive facilitates removably attaching the surface plate 1908 to the core portion 1902.

In further embodiments, the playing implement 1906 may include configured to be peripherally disposed in at least a part around a head of the paddle 1900. Further, the head may include the surface plate 1908 and the core portion 1902. Further, the edge guard may be comprised of at least one material. Further, the at least one material of the edge guard absorbs an impact force imparted on the edge guard for protecting the surface from the impact force.

Further, in some embodiments, the surface plate 1908 may include at least one plate portion in at least one location on the surface plate 1908. Further, the at least one plate portion may be comprised of at least one first layer of material disparate from the at least one layer of material.

Further, in some embodiments, the at least one layer of material may be comprised of at least one of carbon fiber, graphite, fiberglass, and composite materials.

Further, in some embodiments, the surface plate 1908 defines at least one cavity in at least one location on the surface plate 1908.

In an embodiment, the playing implement 1906 may include at least one additional plate portion. Further, the at least one additional plate portion may be configured to be disposed in the at least one cavity in the at least one location based on the removing. Further, the at least one additional plate may be comprised of at least one first layer of material disparate from the at least one layer of material.

Figure 20:
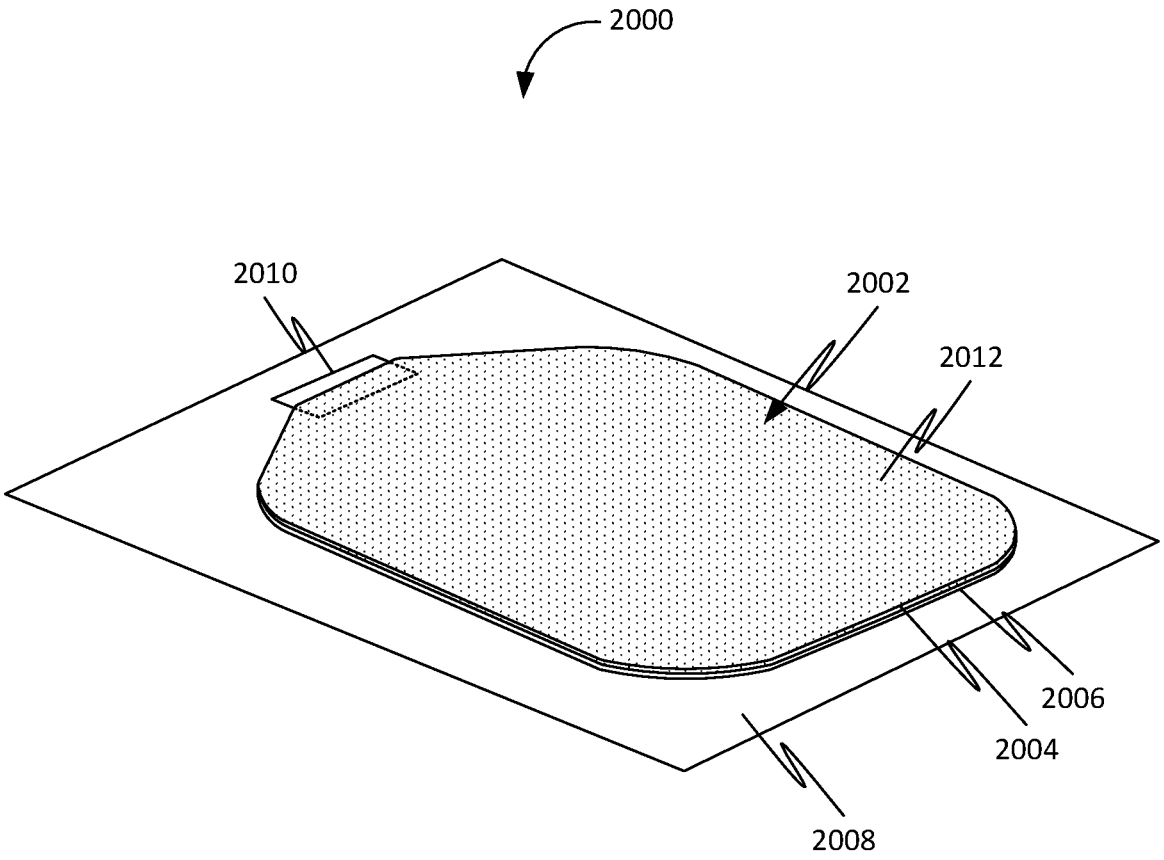
FIG. 20 is a top perspective view of a playing implement 2000 for a paddle (such as a paddle 2500) for facilitating playing with the paddle, in accordance with some embodiments.

FIG. 20 is a top perspective view of a playing implement 2000 for a paddle (such as a paddle 2500) for facilitating playing with the paddle, in accordance with some embodiments. Further, the paddle may include a pickleball paddle. Further, the playing implement 2000 may include a replaceable pickleball paddle surface. Further, the playing implement 2000 may include a surface plate 2002, a backing sheet 2008, and a tab 2010.

Figure 21:
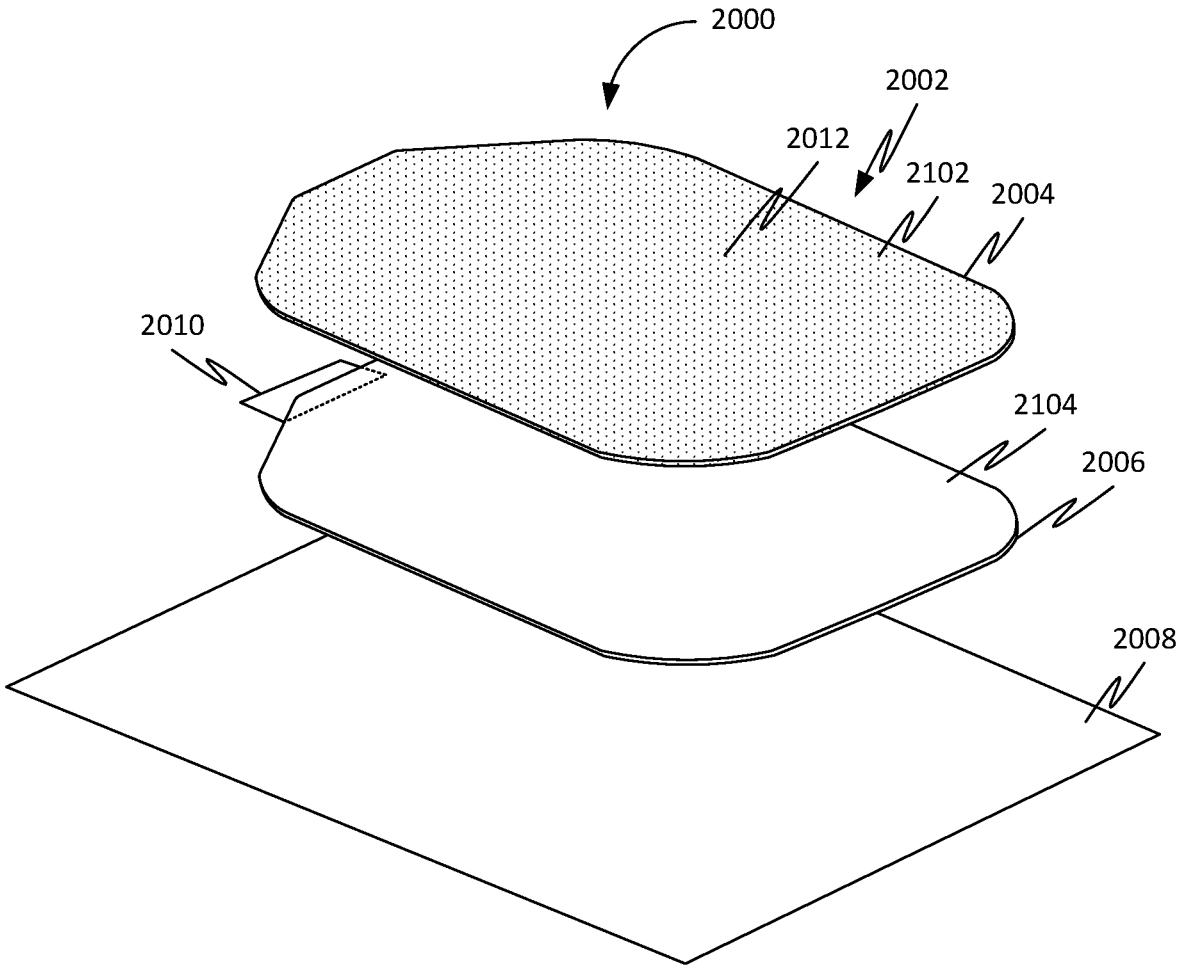
FIG. 21 is a top exploded perspective view of the playing implement 2000, in accordance with some embodiments.
Figure 22:
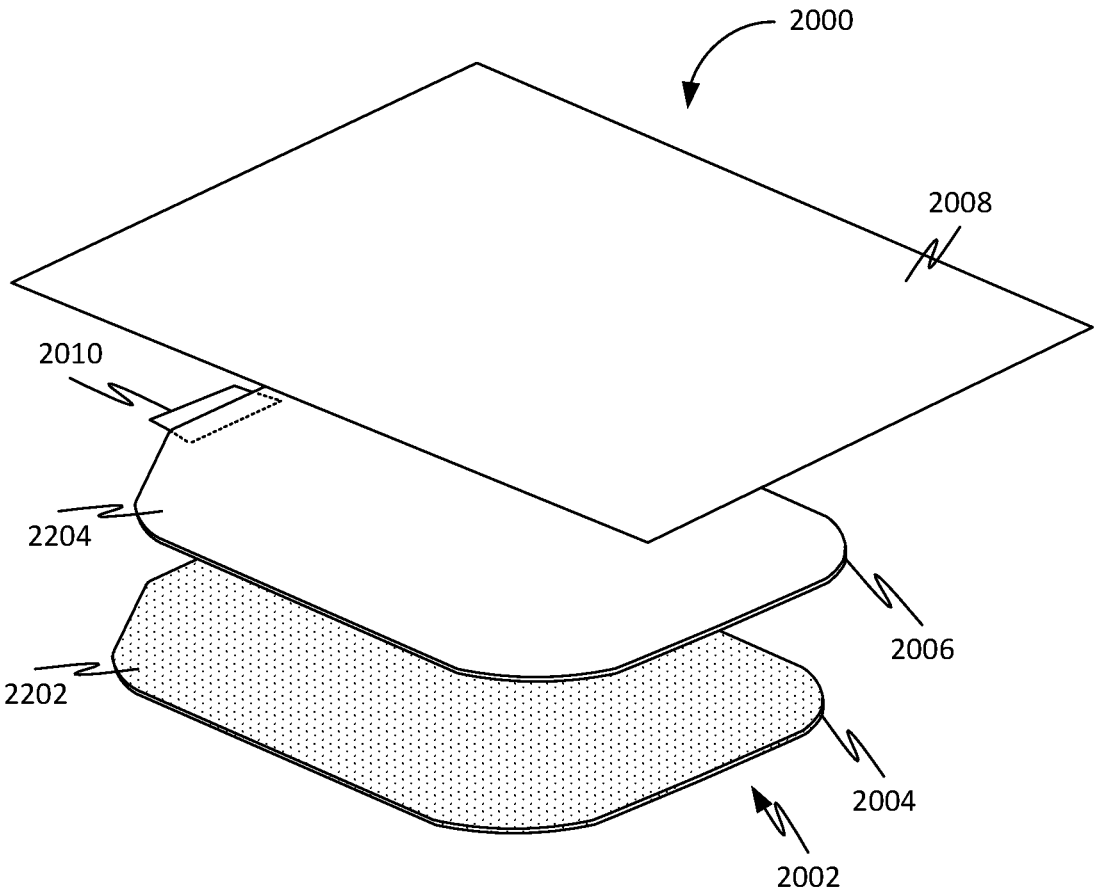
FIG. 22 is a bottom exploded perspective view of the playing implement 2000, in accordance with some embodiments.

Further, the surface plate 2002 may include at least one sheet of carbon fiber 2004 and at least one sheet of adhesive 2006. Further, the at least one sheet of carbon fiber 2004 may be comprised of at least one material comprising carbon fiber. Further, the surface plate 2002 may be a carbon fiber surface sheet. Further, the at least one sheet of carbon fiber 2004 may be a carbon fiber surface sheet. Further, the at least one sheet of carbon fiber 2004 may include an outer surface 2102, as shown in FIG. 21, and an inner surface 2202, as shown in FIG. 22. Further, the at least one sheet of adhesive 2006 may be disposed on the inner surface 2202 of the at least one sheet of carbon fiber 2004. Further, the inner surface 2202 may correspond to an inner side of the at least one sheet of carbon fiber 2004 of the surface plate 2002. Further, the outer surface 2102 of the at least one sheet of carbon fiber 2004 forms a playing surface 2012 of the surface plate 2002. Further, the outer surface 2102 corresponds to an outer side of the at least one sheet of carbon fiber 2004 of the surface plate 2002. Further, the surface plate 2002 has a shape corresponding to a core portion of the paddle. Further, the surface plate 2002 may be configured to be attached to an exterior surface of the core portion based on the at least one sheet of adhesive 2006. Further, the at least one sheet of adhesive 2006 may include a first surface 2104, as shown in FIG. 21, and a second surface 2204, as shown in FIG. 22, opposing the first surface 2104. Further, the at least one sheet of adhesive 2006 may be comprised of at least one adhesive. Further, the first surface 2104 of the at least one sheet of adhesive 2006 may be attached to the inner surface 2202 of the at least one sheet of carbon fiber 2004 based on disposing of the at least one sheet of adhesive 2006 on the inner surface 2202 of the at least one sheet of carbon fiber 2004. Further, the second surface 2204 may be configured to be attached to the exterior surface of the core portion for attaching the surface plate 2002 to the exterior surface of the core portion.

Further, the backing sheet 2008 may be removably attached to the second surface 2204 of the at least one sheet of adhesive 2006. Further, the backing sheet 2008 may be configured to be removed from the second surface 2204 for exposing the second surface 2204 of the at least one sheet of adhesive 2006. Further, the second surface 2204 may be configured to be attached to the exterior surface of the core portion based on the exposing. Further, the backing sheet 2008 may be a backing release paper.

Further, the tab 2010 may be attached to the surface plate 2002. Further, the tab 2010 may be configured for receiving at least one action. Further, the at least one action may include a grabbing and pulling action. Further, the removing of the backing sheet 2008 from the second surface 2204 may be further based on the at least one action received by the tab 2010. Further, the tab 2010 may be a pull tab.

Further, in some embodiments, the outer surface 2102 of the at least one sheet of carbon fiber 2004 may be textured and the inner surface 2202 of the at least one sheet of carbon fiber 2004 may be plain. Further, the inner surface 2202 of the at least one sheet of carbon fiber 2004 may be non-textured, smooth, etc.

Further, in some embodiments, the at least one sheet of carbon fiber 2004 may include at least one layer of unidirectional carbon fiber.

Further, in some embodiments, the at least one sheet of carbon fiber 2004 may include a top layer of unidirectional carbon fiber 2302 and a bottom layer of unidirectional carbon fiber 2304. Further, the top layer of unidirectional carbon fiber 2302 and the bottom layer of unidirectional carbon fiber 2304 are arranged in at least one configuration.

Figure 23:
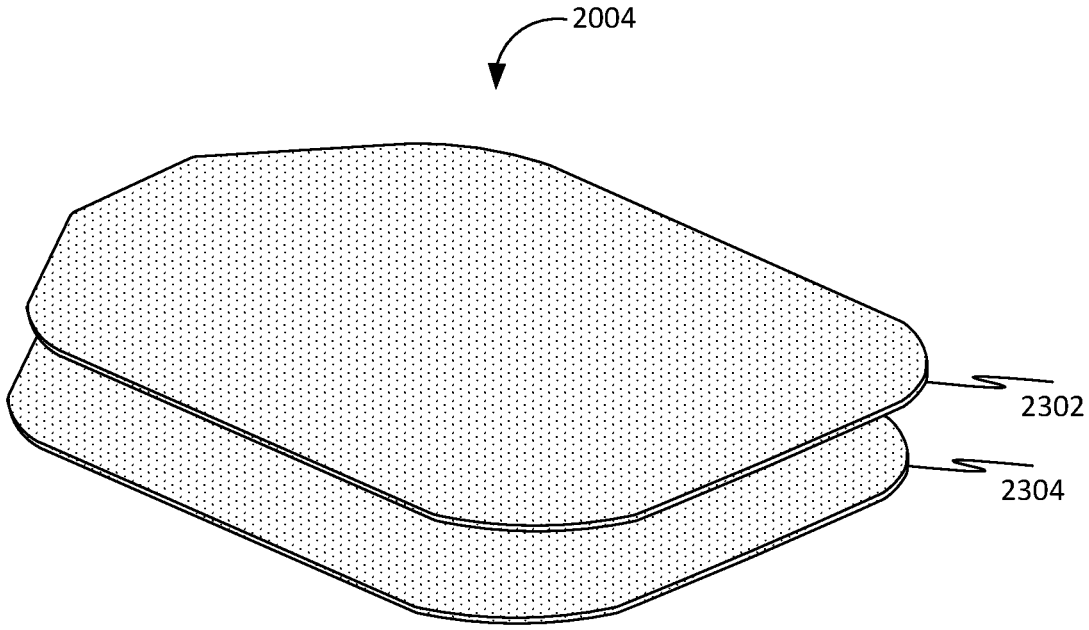
FIG. 23 is a top perspective exploded view of the least one sheet of carbon fiber 2004, in accordance with some embodiments.

Further, in an embodiment, the at least one configuration may include a zero degree configuration. Further, a filament of the top layer of unidirectional carbon fiber 2302, as shown in FIG. 23, may be arranged parallel to a filament of the bottom layer of unidirectional carbon fiber 2304, as shown in FIG. 23, in the zero degree configuration.

Further, in an embodiment, the at least one configuration may include a ninety degree configuration. Further, a filament of the top layer of unidirectional carbon fiber 2302 may be arranged orthogonal to a filament of the bottom layer of unidirectional carbon fiber 2304 in the ninety degree configuration.

Figure 26:
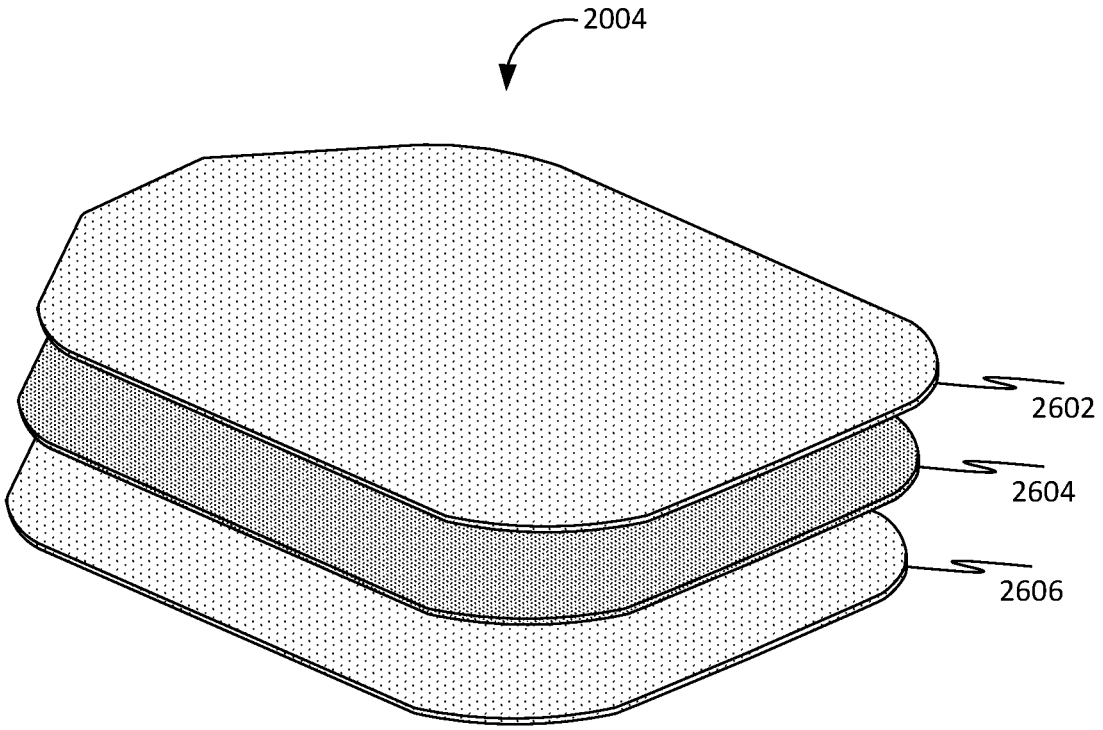
FIG. 26 is a top perspective exploded view of the least one sheet of carbon fiber 2004, in accordance with some embodiments.

Further, in some embodiments, the at least one sheet of carbon fiber 2004 may include a top layer of unidirectional carbon fiber 2602, a middle layer of unidirectional carbon fiber 2604, and a bottom layer of unidirectional carbon fiber 2606, as shown in FIG. 26. Further, the top layer of unidirectional carbon fiber 2602, the middle layer of unidirectional carbon fiber 2604, and the bottom layer of unidirectional carbon fiber 2606 are arranged in at least one configuration. Further, a filament of the middle layer of unidirectional carbon fiber 2604 may be arranged orthogonal to a filament of the top layer of unidirectional carbon fiber 2602 and a filament of the bottom layer of unidirectional carbon fiber 2606 and the filament of the top layer of unidirectional carbon fiber 2602 may be parallel to the filament of the bottom layer of unidirectional carbon fiber 2606 in the at least one configuration.

Further, in an embodiment, the filament of the top layer of unidirectional carbon fiber 2602 and the filament of the bottom layer of unidirectional carbon fiber 2606 may be arranged at zero degrees and the filament of the middle layer of unidirectional carbon fiber 2604 may be arranged at ninety degrees in the at least one configuration.

Further, in some embodiments, the at least one sheet of carbon fiber 2004 may include a woven carbon fiber cloth. Further, the woven carbon fiber cloth may be associated with at least one weave. Further, the at least one weave may include a twill weave, a plain weave, a patterned weave, etc.

Further, in some embodiments, the at least one sheet of adhesive 2006 may be comprised of a differential adhesive. Further, the first surface 2104 has a first coefficient of adhesion and the second surface 2204 has a second coefficient of adhesion. Further, the first coefficient of adhesion may be greater than the second coefficient of adhesion.

Further, in some embodiments, the surface plate 2002 may be configured to be removably attached to the exterior surface of the core portion.

Further, in an embodiment, the tab 2010 may be configured for receiving at least one action. Further, the removing of the surface plate 2002 from the exterior surface may be further based on the at least one action received by the tab 2010. Further, the removing of the surface plate 2002 may include peeling the surface plate 2002.

Further, in some embodiments, the at least one sheet of adhesive 2006 may be comprised of a pressure sensitive adhesive.

FIG. 21 is a top exploded perspective view of the playing implement 2000, in accordance with some embodiments.

FIG. 22 is a bottom exploded perspective view of the playing implement 2000, in accordance with some embodiments.

FIG. 23 is a top perspective exploded view of the least one sheet of carbon fiber 2004, in accordance with some embodiments.

Figure 24:
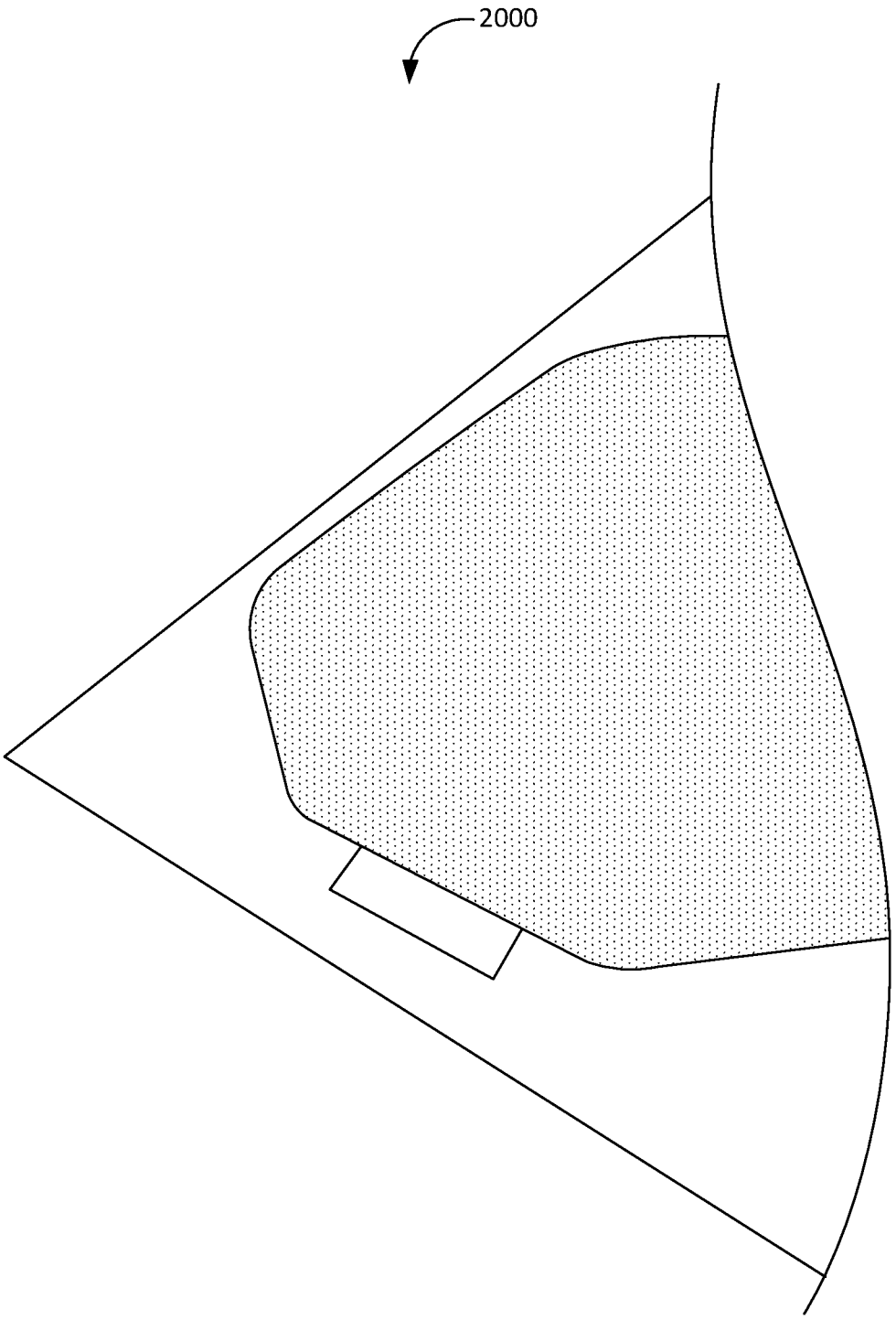
FIG. 24 is a partial top perspective view of the playing implement 2000, in accordance with some embodiments.

FIG. 24 is a partial top perspective view of the playing implement 2000, in accordance with some embodiments.

Figure 25:
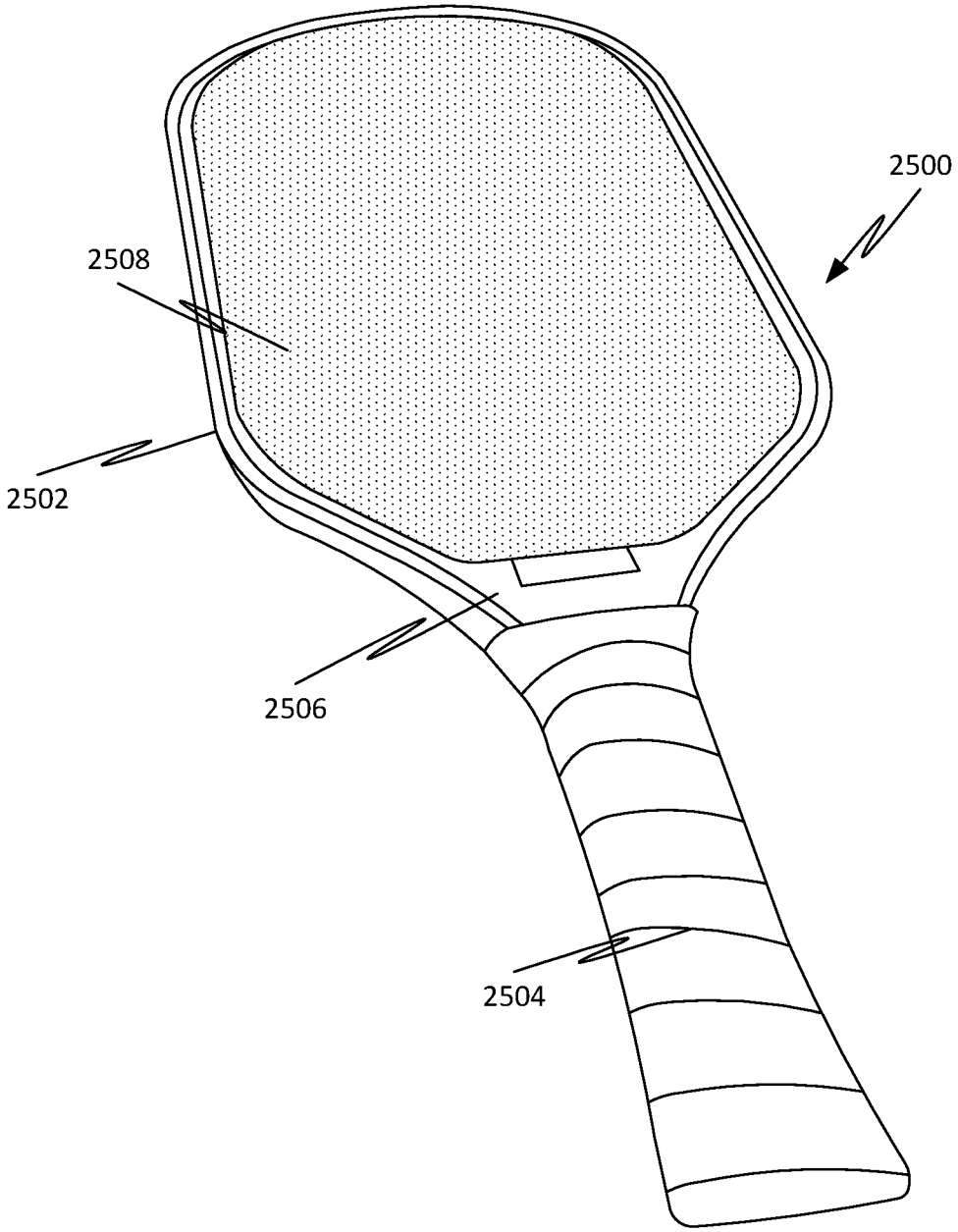
FIG. 25 is a top perspective view of a paddle 2500 with a playing implement 2508 (such as the playing implement 2000) for facilitating playing with the paddle 2500, in accordance with some embodiments.

FIG. 25 is a top perspective view of a paddle 2500 with a playing implement 2508 (such as the playing implement 2000) for facilitating playing with the paddle 2500, in accordance with some embodiments. Further, the paddle 2500 may include a core portion 2502 and a handle 2504. Further, the core portion 2502 may include an exterior surface 2506. Further, the playing implement 2508 may be attached to the exterior surface 2506.

FIG. 26 is a top perspective exploded view of the least one sheet of carbon fiber 2004, in accordance with some embodiments.

According to some aspects, a playing implement for a paddle for facilitating playing with the paddle is disclosed. Further, the playing implement may include a surface plate comprising at least one sheet of carbon fiber and at least one sheet of adhesive. Further, the at least one sheet of carbon fiber may include an outer surface and an inner surface. Further, the at least one sheet of adhesive may be disposed on the inner surface of the at least one sheet of carbon fiber. Further, the outer surface of the at least one sheet of carbon fiber forms a playing surface of the surface plate. Further, the surface plate has a shape corresponding to a core portion of the paddle. Further, the surface plate may be configured to be attached to an exterior surface of the core portion based on the at least one sheet of adhesive.

According to some further aspects, the outer surface of the at least one sheet of carbon fiber may be textured and the inner surface of the at least one sheet of carbon fiber may be plain.

According to some further aspects, the at least one sheet of carbon fiber may include at least one layer of unidirectional carbon fiber.

According to some further aspects, the at least one sheet of carbon fiber may include a top layer of unidirectional carbon fiber and a bottom layer of unidirectional carbon fiber. Further, the top layer of unidirectional carbon fiber and the bottom layer of unidirectional carbon fiber are arranged in at least one configuration.

According to a further aspect, the at least one configuration may include a zero degree configuration. Further, a filament of the top layer of unidirectional carbon fiber may be arranged parallel to a filament of the bottom layer of unidirectional carbon fiber in the zero degree configuration.

According to a further aspect, the at least one configuration may include a ninety degree configuration. Further, a filament of the top layer of unidirectional carbon fiber may be arranged orthogonal to a filament of the bottom layer of unidirectional carbon fiber in the ninety degree configuration.

According to some further aspects, the at least one sheet of carbon fiber may include a top layer of unidirectional carbon fiber, a middle layer of unidirectional carbon fiber, and a bottom layer of unidirectional carbon fiber. Further, the top layer of unidirectional carbon fiber, the middle layer of unidirectional carbon fiber, and the bottom layer of unidirectional carbon fiber are arranged in at least one configuration. Further, a filament of the middle layer of unidirectional carbon fiber may be arranged orthogonal to a filament of the top layer of unidirectional carbon fiber and a filament of the bottom layer of unidirectional carbon fiber and the filament of the top layer of unidirectional carbon fiber may be parallel to the filament of the bottom layer of unidirectional carbon fiber in the at least one configuration.

According to a further aspect, the filament of the top layer of unidirectional carbon fiber and the filament of the bottom layer of unidirectional carbon fiber may be arranged at zero degrees and the filament of the middle layer of unidirectional carbon fiber may be arranged at ninety degrees in the at least one configuration.

According to some further aspects, the at least one sheet of carbon fiber may include a woven carbon fiber cloth.

According to some further aspects, the at least one sheet of adhesive may include a first surface and a second surface opposing the first surface. Further, the first surface of the at least one sheet of adhesive may be attached to the inner surface of the at least one sheet of carbon fiber based on disposing of the at least one sheet of adhesive on the inner surface of the at least one sheet of carbon fiber. Further, the second surface may be configured to be attached to the exterior surface of the core portion for attaching the surface plate to the exterior surface of the core portion.

According to a further aspect, the at least one sheet of adhesive may be comprised of a differential adhesive. Further, the first surface has a first coefficient of adhesion and the second surface has a second coefficient of adhesion. Further, the first coefficient of adhesion may be greater than the second coefficient of adhesion.

According to a further aspect, the playing implement may include a backing sheet removably attached to the second surface of the at least one sheet of adhesive. Further, the backing sheet may be configured to be removed from the second surface for exposing the second surface of the at least one sheet of adhesive. Further, the second surface may be configured to be attached to the exterior surface of the core portion based on the exposing.

According to a further aspect, the playing implement may include a tab attached to the surface plate. Further, the tab may be configured for receiving at least one action. Further, the removing of the backing sheet from the second surface may be further based on the at least one action received by the tab.

According to some further aspects, the surface plate may be configured to be removably attached to the exterior surface of the core portion.

According to a further aspect, the playing implement may include a tab attached to the surface plate. Further, the tab may be configured for receiving at least one action. Further, the removing of the surface plate from the exterior surface may be further based on the at least one action received by the tab.

According to some further aspects, the at least one sheet of adhesive may be comprised of a pressure sensitive adhesive.

According to some aspects, a playing implement for a paddle for facilitating playing with the paddle. Further, the playing implement may include a surface plate, a backing sheet, and a tab. Further, the surface plate may include at least one sheet of carbon fiber and at least one sheet of adhesive. Further, the at least one sheet of carbon fiber may include an outer surface and an inner surface. Further, the at least one sheet of adhesive may be disposed on the inner surface of the at least one sheet of carbon fiber. Further, the outer surface of the at least one sheet of carbon fiber forms a playing surface of the surface plate. Further, the surface plate has a shape corresponding to a core portion of the paddle. Further, the surface plate may be configured to be attached to an exterior surface of the core portion based on the at least one sheet of adhesive. Further, the at least one sheet of adhesive may include a first surface and a second surface opposing the first surface. Further, the first surface of the at least one sheet of adhesive may be attached to the inner surface of the at least one sheet of carbon fiber based on disposing of the at least one sheet of adhesive on the inner surface of the at least one sheet of carbon fiber. Further, the second surface may be configured to be attached to the exterior surface of the core portion for attaching the surface plate to the exterior surface of the core portion. Further, the backing sheet may be removably attached to the second surface of the at least one sheet of adhesive. Further, the backing sheet may be configured to be removed from the second surface for exposing the second surface of the at least one sheet of adhesive. Further, the second surface may be configured to be attached to the exterior surface of the core portion based on the exposing. Further, the tab may be attached to the surface plate. Further, the tab may be configured for receiving at least one action. Further, the removing of the backing sheet from the second surface may be further based on the at least one action received by the tab.

According to some aspects, a playing implement for a paddle for facilitating playing with the paddle. Further, the playing implement may include a surface plate and a tab. Further, the surface plate may include at least one sheet of carbon fiber and at least one sheet of adhesive. Further, the at least one sheet of carbon fiber may include an outer surface and an inner surface. Further, the at least one sheet of adhesive may be disposed on the inner surface of the at least one sheet of carbon fiber. Further, the outer surface of the at least one sheet of carbon fiber forms a playing surface of the surface plate. Further, the surface plate has a shape corresponding to a core portion of the paddle. Further, the surface plate may be configured to be removably attached to an exterior surface of the core portion based on the at least one sheet of adhesive. Further, the tab may be attached to the surface plate. Further, the tab may be configured for receiving at least one action. Further, the removing of the surface plate from the exterior surface may be further based on the at least one action received by the tab.

Although the present disclosure has been explained in relation to its preferred embodiment, it is to be understood that many other possible modifications and variations can be made without departing from the spirit and scope of the disclosure.

What is claimed is:

1. A playing implement for a paddle for facilitating playing with the paddle, wherein the playing implement comprises a replaceable surface plate having an inner side and an outer side, wherein the surface plate is comprised of at least one layer of material having a textured surface on the outer side, wherein the surface plate comprises a layer of at least one differential adhesive on the inner side of the surface plate, wherein the layer of the at least one differential adhesive facilitates removably attaching the surface plate to the paddle using the at least one adhesive, wherein the outer side comprises a playing surface, wherein the outer side opposes the inner side, and the surface plate further comprises a pull tab configured to pull the surface plate away from the paddle.

2. The playing implement of claim 1 further comprising an edge guard configured to be peripherally disposed in at least a part around a head of the paddle, wherein the edge guard is comprised of at least one material, wherein the at least one material of the edge guard absorbs an impact force imparted on the edge guard for protecting the outer side of the surface plate from the impact force.

3. The playing implement of claim 1, wherein the surface plate comprises at least one plate portion in at least one location on the surface plate, wherein the at least one plate portion is comprised of at least one first layer of material disparate from the at least one layer of material.

4. The playing implement of claim 1, wherein the at least one layer of material is comprised of at least one of carbon fiber, aramid fiber, graphite, fiberglass, and composite materials.

5. A paddle with a playing implement for facilitating playing with the paddle, the paddle comprising:

a core portion;

a handle connected to the core portion; and the playing implement comprises a replaceable surface plate having an inner side and an outer side, wherein the surface plate is comprised of at least one layer of material having a textured surface on the outer side, wherein the surface plate is configured to be removably attached to the paddle using at least one differential adhesive, wherein the at least one differential adhesive is applicable on the inner side of the surface plate, wherein the outer side of the surface plate comprises a playing surface, wherein the outer side opposes the inner side, and the surface plate further comprises a pull tab configured to pull the surface plate away from the paddle.

6. The paddle of claim 5, wherein the surface plate comprises a layer of the at least one adhesive on the inner side of the surface plate, wherein the layer of the at least one adhesive facilitates removably attaching the surface plate to the paddle.

7. The paddle of claim 5 further comprising an edge guard configured to be peripherally disposed in at least a part around a head of the paddle, wherein the edge guard is comprised of at least one material, wherein the at least one material of the edge guard absorbs an impact force imparted on the edge guard for protecting the outer side of the surface plate from the impact force.

8. The paddle of claim 5, wherein the surface plate comprises at least one plate portion in at least one location on the surface plate, wherein the at least one plate portion is comprised of at least one first layer of material disparate from the at least one layer of material.

9. The paddle of claim 5, wherein the at least one layer of material is comprised of at least one of carbon fiber, graphite, fiberglass, and composite materials.

10. The paddle of claim 9, wherein the surface plate defines at least one cavity in at least one location on the surface plate.

* * * * *